US009950529B2

(12) United States Patent
Koide et al.

(10) Patent No.: US 9,950,529 B2
(45) Date of Patent: Apr. 24, 2018

(54) INK JET PRINTER AND INK JET HEAD

(71) Applicant: BROTHER KOGYO KABUSHIKI KAISHA, Nagoya-shi, Aichi-ken (JP)

(72) Inventors: Shohei Koide, Nagoya (JP); Atsushi Ito, Nagoya (JP)

(73) Assignee: BROTHER KOGYO KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 15/006,276

(22) Filed: Jan. 26, 2016

(65) Prior Publication Data

US 2016/0288496 A1 Oct. 6, 2016

(30) Foreign Application Priority Data

Mar. 31, 2015 (JP) ..... 2015-073701

(51) Int. Cl.

| | |
|---|---|
| ***B41J 2/145*** | (2006.01) |
| ***B41J 2/505*** | (2006.01) |
| ***B41J 2/045*** | (2006.01) |
| ***B41J 2/14*** | (2006.01) |
| ***B41J 2/51*** | (2006.01) |
| ***B41J 2/21*** | (2006.01) |

(52) U.S. Cl.

CPC ..... *B41J 2/145* (2013.01); *B41J 2/04551* (2013.01); *B41J 2/14209* (2013.01); *B41J 2/21* (2013.01); *B41J 2/5056* (2013.01); *B41J 2/51* (2013.01); *B41J 2002/14225* (2013.01); *B41J 2002/14459* (2013.01)

(58) Field of Classification Search

CPC ..... B41J 2/15; B41J 2/145; B41J 2/5056
See application file for complete search history.

(56) References Cited

U.S. PATENT DOCUMENTS 6,527,366 B1 * 3/2003 Byers ..... B41J 2/21 347/15
2001/0019345 A1 9/2001 Endo
(Continued)

FOREIGN PATENT DOCUMENTS

EP 0955174 11/1999
JP H10-278317 10/1998
(Continued)

OTHER PUBLICATIONS

Notice of Reasons for Rejection for JP application No. 2013-252750 dated Feb. 7, 2017.

*Primary Examiner* — Shelby Fidler
(74) *Attorney, Agent, or Firm* — Haug Partners LLP

(57) ABSTRACT

There is provided an ink jet printer including a carriage, and an ink jet head. The ink jet head has two first nozzle groups to jet a first ink, two second nozzle groups to jet a second ink, and two third nozzle groups to jet the second ink. Each of the first, second and third nozzle groups includes a plurality of nozzles arrayed at a pitch P along a second direction. The second nozzle groups accord respectively with the first nozzle groups in terms of nozzle position in the second direction, the third nozzle groups are dislocated respectively from the second nozzle groups in terms of nozzle position in the second direction, and any two groups selected from the first and second nozzle groups are arranged respectively on two opposite sides of each of the third nozzle groups in the first direction.

16 Claims, 14 Drawing Sheets

(56) References Cited

U.S. PATENT DOCUMENTS

| | | | | |
|---|---|---|---|---|
| 2003/0090539 | A1* | 5/2003 | Lahut | B41J 2/2103 347/43 |
| 2006/0103691 | A1* | 5/2006 | Dietl | B41J 2/1404 347/40 |
| 2007/0085869 | A1 | 4/2007 | Hirano et al. | |
| 2007/0206058 | A1* | 9/2007 | Takahashi | B41J 2/145 347/54 |
| 2007/0285463 | A1* | 12/2007 | Kanda | B41J 2/1433 347/40 |
| 2008/0012898 | A1* | 1/2008 | Tsuchii | B41J 2/145 347/40 |
| 2008/0036816 | A1* | 2/2008 | Nishida | B41J 2/16508 347/30 |
| 2010/0328384 | A1* | 12/2010 | Kyoshima | B41J 2/2132 347/12 |
| 2011/0148966 | A1* | 6/2011 | Yoshida | B41J 2/2103 347/14 |
| 2015/0054869 | A1* | 2/2015 | Miyamoto | B41J 2/15 347/9 |
| 2015/0158294 | A1* | 6/2015 | Koide | B41J 2/14233 347/12 |

FOREIGN PATENT DOCUMENTS

| | | | |
|---|---|---|---|
| JP | H10-309815 | 11/1998 | |
| JP | H11-320926 | 11/1999 | |
| JP | 2006076010 A * | 3/2006 | B41J 2/1433 |
| JP | 2007-137049 | 6/2007 | |
| JP | 2007-261205 | 10/2007 | |
| JP | 2015-110277 | 6/2015 | |

* cited by examiner

INK JET PRINTER AND INK JET HEAD

CROSS REFERENCE TO RELATED APPLICATION

The present application claims priority from Japanese Patent Application No. 2015-073701, filed on Mar. 31, 2015, the disclosure of which is incorporated herein by reference in its entirety.

FIELD OF THE INVENTION

The present invention relates to ink jet printers and ink jet heads.

DESCRIPTION OF THE RELATED ART

Conventionally, there are known ink jet printers applying such a method as to print image and the like by jetting ink from respective nozzles toward a recording medium while moving an ink jet head having the plurality of nozzles in a predetermined scanning direction. There are known ink jet heads used in such ink jet printers to have four types of nozzle rows jetting inks of four colors: black (K), cyan (C), magenta (M), and yellow (Y). For example, two nozzle rows are provided for the ink of one color such that there are eight nozzle rows in total for the four colors.

Further, there is known an ink jet head in which the total eight nozzle rows are arranged symmetrically in the scanning direction to jet the four color inks. In particular, first, the two nozzle rows for yellow are arranged adjacently in the center according to the scanning direction. Then, the two nozzle rows for magenta, the two nozzle rows for cyan and the two nozzle rows for black are arranged in this sequence outwardly on the two opposite sides of the two nozzle rows for yellow according to the scanning direction. That is, from one side to the other side according to the scanning direction, the eight nozzle rows are aligned in the sequence of "K", "C", "M", "Y", "Y" "M", "C", and "K". By virtue of this, when a bidirectional printing is carried out, the sequence of jetting the four color inks is the same for the ink jet head to move in one direction and to move in the other direction.

However, the present applicant considers a head in which the number of nozzles is increased only for the nozzles jetting a particular ink. By adopting this structure of the had it is possible to raise the print speed when jetting that particular ink or to raise the resolution.

The following explanation will be made with such an example as in the case of the abovementioned particular ink being a black ink and the other inks being those of other colors such as yellow, cyan, magenta, and the like, As nozzle groups to jet the black ink, there are provided: (I) a nozzle group used simultaneously with nozzle groups for the (other) color inks (to be referred to below as the nozzle group I), and (II) a nozzle group not used simultaneously with the nozzle groups for the color inks (to be referred to below as the nozzle group II). When printing is carried out by using both the black ink and the color inks, only the nozzle group I for the black ink is used together with the nozzle groups jetting the color inks. On the other hand, when printing is carried out by using the black ink only, both the nozzle group I and the nozzle group II are used.

Here, differing from the nozzle group I, the abovementioned nozzle group II is not used simultaneously with the nozzle groups for the color inks, and thus has a lower ink jet frequency than the nozzle group I. Therefore, it is conceivable to give rise to such problems as follows.

Suppose that there is a case where after the nozzle group I for black and the nozzle groups for color are used to carry out a color print, the nozzle group I and the nozzle group ii are used to carry out a black-and-white print using the black ink only. In this case, because the nozzle group I has jetted the ink until just before the black-and-white print is carried out, the ink temperature increases due to the heat produced in the drive elements for jetting the ink. In contrast to this, because the nozzle group II has not yet jet any ink, the ink temperature remains as low as it is. Hence, when the black-and-white print is carried out, then between the nozzle group I and the nozzle group II both of which jet the same black ink, a difference occurs in the ink jet amount from the nozzles due to the difference in the ink temperature. This difference in the ink jet amount causes density unevenness to occur in printed images.

SUMMARY

It is an object of the present teaching to suppress the difference of amount of ink jetted (hereinafter referred to as "ink jet amount") to a low level between two types of nozzle groups which jet the same type of ink but differ in jet frequency, According to a first aspect of the present teaching, there is provided an ink jet printer including:

a carriage configured to move in a first direction; and an ink jet head mounted on the carriage, and including two first nozzle groups to jet first ink, two second nozzle groups to jet second ink, and two third nozzle groups to jet the second ink;

wherein each of the first nozzle groups includes a plurality of nozzles arrayed at a pitch P along a second direction intersecting the first direction, each of the second nozzle groups includes a plurality of nozzles arrayed at the pitch P along the second direction, and each of the third nozzle groups includes a plurality of nozzles arrayed at the pitch P along the second direction; and wherein positions of the nozzles of the second nozzle groups are coincident with those of the nozzles of the first nozzle groups in the second direction, positions of the nozzles of the third nozzle groups are dislocated respectively from those of the nozzles of the second nozzle groups in the second direction, and one of the first nozzle groups and the second nozzle groups are arranged respectively on both sides of each of the third nozzle groups in the first direction.

According to a second aspect of the present teaching, there is provided an ink jet printer including:

a carriage configured to move in a first direction;

an ink jet head mounted on the carriage, and including two first nozzle groups to jet a first ink, two second nozzle groups to jet a second ink, and two third nozzle groups to jet the second ink; and a controller configured to control the ink jet head, wherein each of the first nozzle groups includes a plurality of nozzles arrayed at pitch P along a second direction intersecting the first direction, each of the second nozzle groups includes a plurality of nozzles arrayed at the pitch P along the second direction, and each of the third nozzle groups includes a plurality of nozzles arrayed at the pitch P along the second direction;

wherein the controller is configured to control the ink jet head to carry out ink jetting from the first nozzle groups and from the second nozzle groups but no ink jetting from the third nozzle groups, and to control the ink jet head to carry out ink jetting from the second nozzle groups and from the third nozzle groups but no ink jetting from the first nozzle groups; and wherein one of the first and second nozzle groups are arranged on both sides of each of the third nozzle groups in the first direction.

Such a process is referred to as a first printing process that the inks are jetted from the first nozzle groups and from the second nozzle groups but no ink is jetted from the third nozzle groups, while such a process is referred to as a second printing process that the ink is jetted from the second nozzle groups and from the third nozzle groups but no ink is jetted from the first nozzle groups. Between the nozzle groups jetting the second ink, the second nozzle groups are used simultaneously with the first nozzle groups jetting the first ink in the first printing process. On the other hand, the third nozzle groups are used simultaneously only with the second nozzle groups in the second printing process, but not used simultaneously with the first nozzle groups with the ink of a different type. Therefore, the ink jet frequency is different between the second nozzle groups and the third nozzle groups such that right before the second printing process is carried out, a temperature difference may arise between the second nozzle groups and the third nozzle groups.

In this regard according to the present teaching, however, first, the two third nozzle groups are arranged separately in the first direction and, two groups selected from the first and second nozzle groups are arranged on the two opposite sides of each of the third nozzle groups. That is, each of the third nozzle groups is arranged to be interposed between two of the first and second nozzle groups. By virtue of this, even in the case of the first printing process using the first nozzle groups and the second nozzle groups but not using the third nozzle groups, the ink temperature also increases in the third nozzle groups interposed between the first nozzle groups and the second nozzle groups in which the ink temperatures increase respectively. By virtue of this, the difference in ink temperature is reduced between the second nozzle groups and the third nozzle groups when starting the second printing process, thereby suppressing the density unevenness in images.

According to a third aspect of the present teaching, there is provided an ink jet head configured to move in a first direction while jetting inks to a recording medium being conveyed in a second direction intersecting the first direction, the ink jet head including:

two first nozzle groups which are configured to jet a first ink and each of which includes a plurality of nozzles arrayed at a pitch P along the second direction;

two second nozzle groups which are configured to jet a second ink and each of which includes a plurality of nozzles arrayed at the pitch P along the second direction, positions of the nozzles in the second nozzle groups are coincide with those of the nozzles in the first nozzle groups in the second direction; and two third nozzle groups which are configured to jet the second ink and each of which includes a plurality of nozzles arrayed at the pitch P along the second direction, positions of the nozzles in the third nozzle groups being dislocated respectively from those of the nozzles in the second nozzle groups in the second direction, wherein one of the first and second nozzle groups are arranged on both sides of each of the third nozzle groups in the first direction.

BRIEF DESCRIPTION OF THE DRAWINGS

FIGS. 7A and 7B are explanatory diagrams for an image print, wherein FIG. 7A shows a configuration that third nozzle groups are dislocated downstream in a conveyance direction from second nozzle groups, whereas FIG. 7B shows a configuration that the third nozzle groups are dislocated upstream in the conveyance direction;

DESCRIPTION OF THE EMBODIMENTS

<First Embodiment>

Next, a first embodiment of the present teaching will be explained.

(A Schematic Configuration of a Printer)

Figure 1:
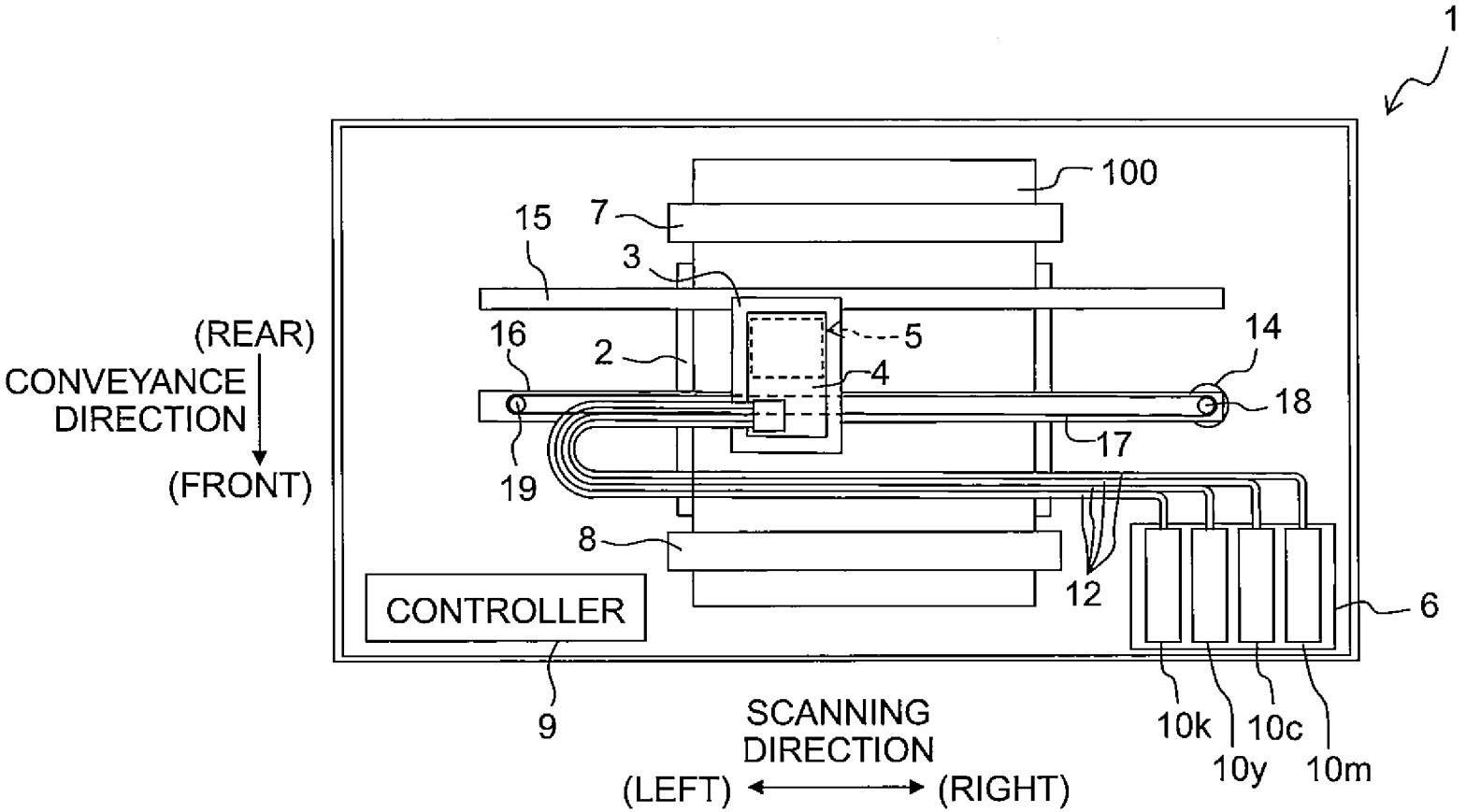
FIG. 1 is a schematic plan view of a printer according to a first embodiment of the present teaching.

As depicted in FIG. 1, a printer 1 includes a platen 2, a carriage 3, a sub-tank 4, an ink jet head 5, a holder 6, a paper feed roller 7, a paper discharge roller 8, a controller 9, and the like. Further, hereinbelow, the near side of the page of FIG. 1 will be defined as "upper side" or "upside" of the printer 1 while the far side of the page will be defined as "lower side" or "downside" of the printer 1. Further, the front-rear direction and left-right direction depicted in FIG. 1 are defined as the "front-rear direction" and "left-right direction" of the printer 1, respectively.

On the upper surface of the platen 2, there is carried a sheet of recording paper 100 which is a recording medium, Further, two guide rails 15 and 16 are provided above the platen 2 to extend parallel to the left-right direction of FIG. 1 (to be also referred to as a scanning direction).

The carriage 3 is fitted on the two guide rails 15 and 16 to be movable reciprocatingly in the scanning direction along the two guide rails 15 and 16 in a region facing the platen 2. Further, the carriage 3 is fitted with a drive belt 17. The drive belt 17 is an endless belt stretched on and around two pulleys 18 and 19. The pulley 18 is linked to a carriage drive motor 14. The carriage drive motor 14 drives the pulley 18 to rotate such that the drive belt 17 moves around to thereby reciprocatingly move the carriage 3 in the scanning direction.

The sub-tank 4 and the ink jet head 5 are mounted on the carriage 3. The sub-tank 4 is connected with the holder 6 through four tubes 12. Four ink cartridges 10 are installed in the holder 6 in a removable manner to respectively retain the ink of four colors (black, yellow, cyan, and magenta). The four color inks are supplied via the tubes 12 from the four ink cartridges 10 installed in the holder 6, respectively.

Further, in the following explanation, the letters "k" denotes black, "y" denotes yellow, "c" denotes cyan and "m" denotes magenta. These letters will be appropriately assigned to the components corresponding respectively to the ink of black (K), yellow (Y), cyan (C) and magenta (M), following the reference numerals denoting those components. For example, the ink cartridge 10*k* refers to the ink cartridge 10 retaining the black ink. Further, excepting the black ink, the three color inks of yellow, cyan and magenta may sometimes be collectively referred to as "color inks". Further, in the following explanation, the three color inks of yellow, can and magenta are taken to be an example as the color inks, However, without being necessarily limited to those three color inks, it is also possible to use, for example, white ink and/or light colored inks such as light cyan and light magenta.

The ink jet head 5 is provided below the sub-tank 4. The ink jet head 5 is supplied with the four color inks from the sub-tank 4. The ink jet head 5 has four types of nozzles 47 (see FIG. 3 and FIGS. 4A and 4B) in its lower surface to respectively jet the four color inks. In the first embodiment, the ink jet head 5 is a recording head of serial type, that is, jetting the inks from the plurality of nozzles 47 toward the recording paper 100 while moving together with the carriage 3 in the scanning direction. A detailed description will be made later on a specific channel structure of the ink jet head 5.

A transport motor 13 (see FIG. 2) synchronizes and drives the paper feed roller 7 and the paper discharge roller 8 to rotate, respectively. The paper feed roller 7 and the paper discharge roller 8 cooperate to transport the recording paper 100 carried on the platen 2 in a conveyance direction (frontward) in FIG. 1.

Figure 2:
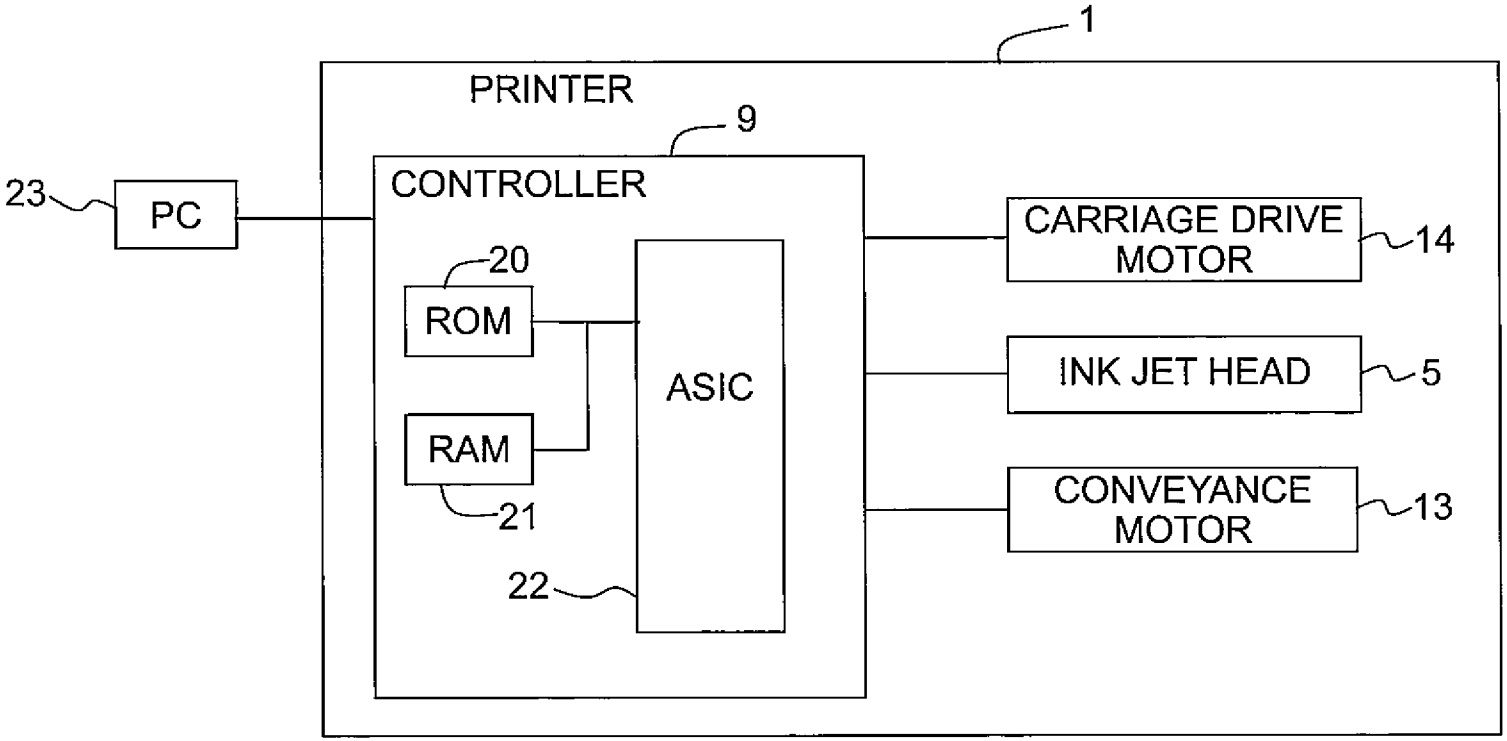
FIG. 2 is a block diagram schematically depicting an electrical configuration of the printer according to the first embodiment.

The controller 9 depicted in FIG. 2 includes a ROM (Read Only Memory) 20, a RAM (Random Access Memory) 21, an ASIC (Application Specific Integrated Circuit) 22 including various types of control circuits, etc. As depicted in FIG. 2, the controller 9 is connected with various devices in the printer 1, such as the ink jet head 5, the carriage drive motor 14, the conveyance motor 13 and the like. Further, the controller 9 is also connected with a PC 23 which is an external device.

Following programs stored in the ROM 20, the controller 9 uses the ASIC 22 to carry out the following printing process. That is, based on a print command sent from the PC 23, the controller 9 controls the ink jet head 5, the carriage drive motor 14, the conveyance motor 13 to print images, characters and the like on the recording paper 100. In more detail, the controller 9 causes the ink jet head 5 to jet the inks respectively from the plurality of nozzles 47 to the recording paper 100 carried on the platen 2 while moving the carriage 3 in the scanning direction. Further, the two rollers 7 and 8 conveys the recording paper 100 in the conveyance direction by a predetermined length. Images and the like are printed on the recording paper 100 by alternately and repetitively carrying out the abovementioned ink jet operation of the ink jet head 5 and conveyance operation of the rollers 7 and 8. Further, in the above explanation, the controller 9 includes the ROM, RAM, and ASIC. However, the present teaching is not limited to this configuration, but the controller 9 may include other hardware configurations. For example, the controller 9 may include two or more ICs such as ASICs to share the processing.

<Details of the Ink Jet Head>

Figure 3:
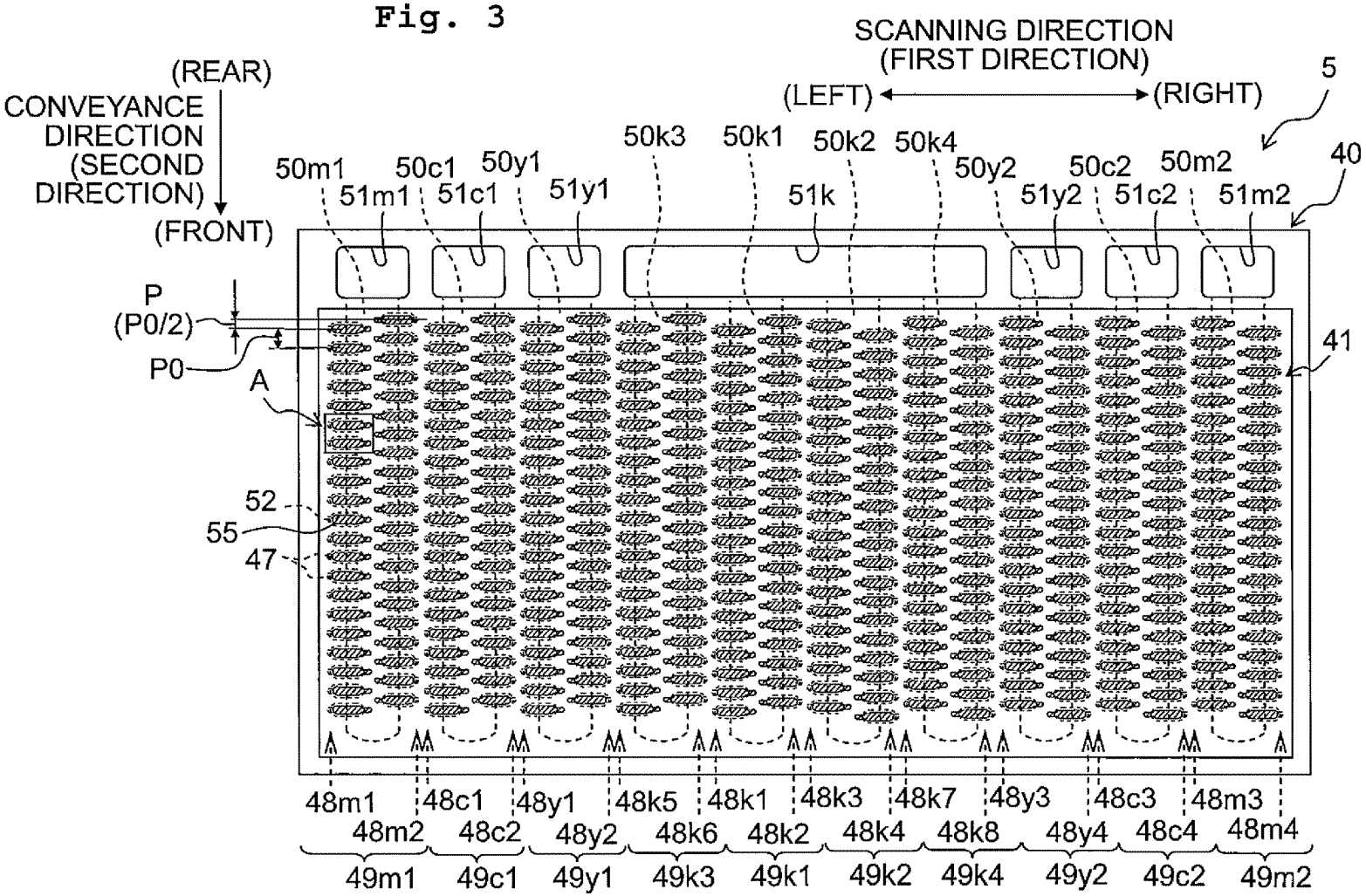
FIG. 3 is a top view of an ink jet head.
Figure 4A:
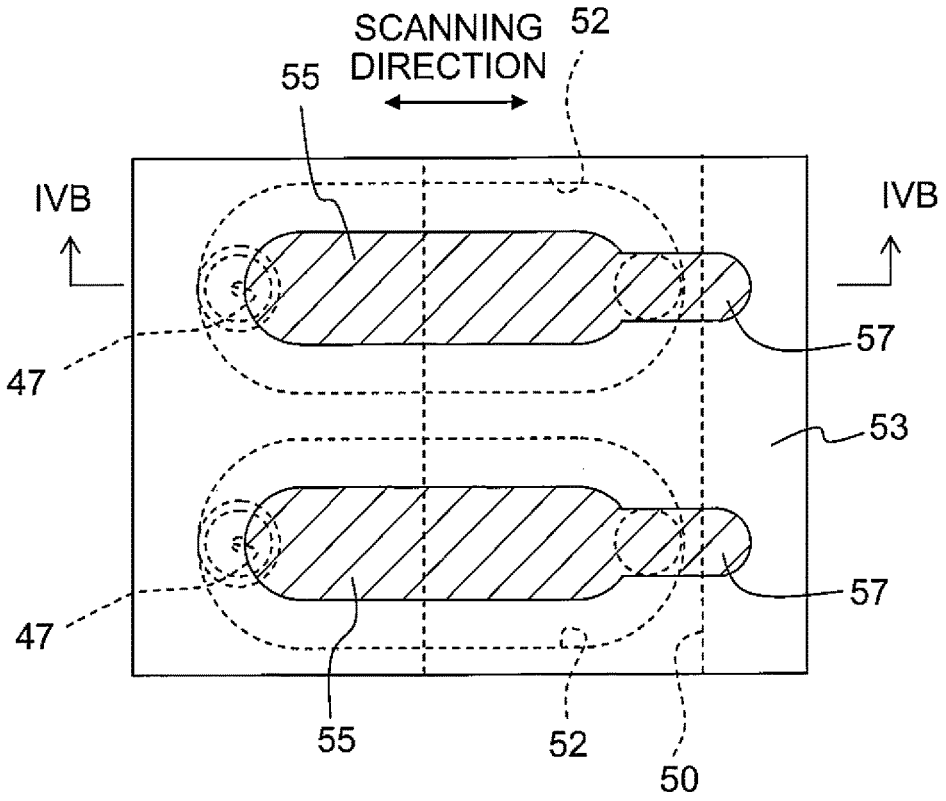
FIG. 4A is an enlarged view of part A of FIG. 3.
Figure 4B:
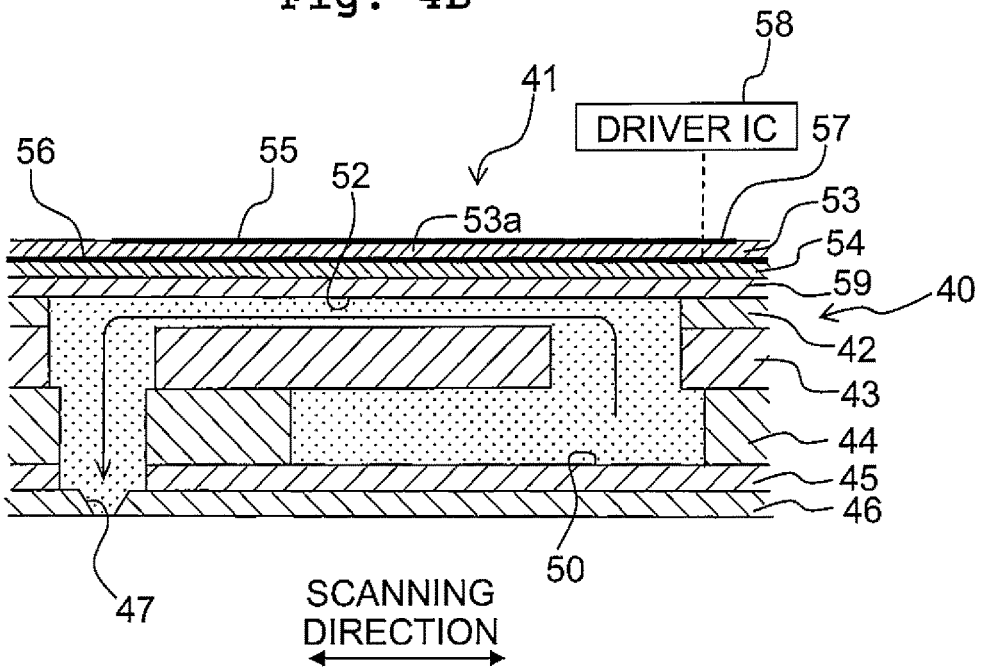
FIG. 4B is a cross-sectional view taken along the line IVB-IVB of FIG. 4A.

As depicted in FIG. 3 and FIGS. 4A and 4B, the ink jet head 5 includes a channel structure 40 and a piezoelectric actuator 41.

<The Channel Structure>

As depicted in FIG. 4B, the channel structure 40 includes five plates 42 to 46. The lowermost plate 46 of the five plates 42 to 46 is a nozzle plate formed with the plurality of nozzles 47. On the other hand, in the other four upper plates 42 to 45, channels are formed to include manifolds 50, pressure chambers 52 and the like in communication with the plurality of nozzles 47.

As depicted in FIG. 3, seven supply ports 51 are formed to align in the scanning direction, in the upper surface of such an end portion of the channel structure 40 as on the upstream side in the conveyance direction. These supply ports 51 are supplied with the four color inks from the sub-tank 4 (see FIG. 1) located above the ink jet head 5. The seven supply ports 51 are one supply port 51*k* for black, two supply ports 51*y*1 and 51*y*2 for yellow, two supply ports 51*c*1 and 51*c*2 for cyan, and two supply ports 51*m*1 and 51*m*2 for magenta.

The seven supply ports 51 are aligned in the scanning direction. In detail, first, the supply port 51*k* for black is arranged in the center according to the scanning direction. Then, toward both the left and right sides from the supply port 51*k* as the center, the supply ports 51 for color are arranged bisymmetrically in the order of the supply ports 51*y* for yellow, the supply ports 51*c* for cyan, and the supply ports 51*m* for magenta.

Further, inside the channel structure 40, the plurality of manifolds 50 are formed to communicate with the seven supply ports 51 and extend in the conveyance direction. In more detail, they are four manifolds 50*k*1 to 50*k*4 in communication with the supply port 51*k* for black, two manifolds 50*y*1 and 50*y*2 in respective communication with the two supply ports 51*y*1 and 51*y*2 for yellow, two manifolds 50*c*1 and 50*c*2 in respective communication with the two supply ports 51*c*1 and 51*c*2 for cyan, and two manifolds 50*m*1 and 50*m*2 in respective communication with the two supply ports 51*m*1 and 51*m*2 for magenta. Further, in the figure, it is configured to supply the ink from the one supply port 51*k* for black to the four manifolds 50*k*1 to 50*k*4. Therefore, the supply port 51*k* for black is larger in aperture size than the supply ports 51 for the other inks. However, this configuration is not necessary but, for example, four supply ports 51*k* may be provided to communicate respectively with the four manifolds 50*k*1 to 50*k*4 for black.

The channel structure 40 has the plurality of nozzles 47 formed in the lowermost layered nozzle plate 46, and the plurality of pressure chambers 52 formed in the uppermost layered plate 42. As depicted in FIG. 3, the plurality of nozzles 47 are arrayed along the conveyance direction to form 20 nozzle rows 48 in total. Detailed explanations will be made later on the arrayal of those plurality of nozzles 47. The plurality of pressure chambers 52 are arrayed along the conveyance direction in positions above the manifolds 50 to correspond respectively to the 20 nozzle rows 48 mentioned above. Further, two rows of the pressure chambers are connected to one of the manifolds 50.

As depicted in FIG. 4B, each of the pressure chambers 52 is in communication with the corresponding nozzle 47. Then, as indicated by the arrow in FIG. 4B, inside the channel structure 40, a plurality of individual channels are formed to branch from each of the manifolds 50, pass through the pressure chambers 52, and reach the nozzles 47, <Piezoelectric Actuator>

The piezoelectric actuator 41 is joined to the upper surface of the channel structure 40 to cover the plurality of pressure chambers 52. As depicted in FIG. 3 and FIGS. 4A and 4B, the piezoelectric actuator 41 includes an ink sealing film 59, two piezoelectric layers 53 and 54, a plurality of individual electrodes 55, and a common electrode 56.

The ink sealing film 59 is a thin film formed of a material of low ink permeability, e.g., a metallic material such as stainless steel or the like. The ink sealing film 59 is joined to the upper surface of the channel structure 40 to cover the plurality of pressure chambers 52.

The two piezoelectric layers 53 and 54 are made respectively of a piezoelectric material whose primary ingredient is lead zirconate titanate which is a mixed crystal of lead titanate and lead zirconate. The piezoelectric layers 53 and 54 are arranged on the upper surface of the ink sealing film 59 in such a state as layered on each other.

The plurality of individual electrodes 55 are arranged on the upper surface of the upper piezoelectric layer 53. In more detail, as depicted in FIGS. 4A and 4B, each of the individual electrodes 55 is arranged in an area of the upper surface of the piezoelectric layer 53 facing a central portion of the corresponding pressure chamber 52. The plurality of individual electrodes 55 are arrayed to correspond respectively to the plurality of pressure chambers 52. An individual terminal 57 is drawn out from each of the individual electrodes 55. An undepicted wiring member is connected to the plurality of individual terminals 57. Thus, the plurality of individual electrodes 55 are electrically connected with a driver IC 58 mounted on the wiring member. Based on a signal from the controller 9 (see FIGS. 1 and 2), the driver IC 58 selectively applies one of a predetermined drive potential and a ground potential to each of the individual electrodes 55.

The common electrode 56 is arranged between the two piezoelectric layers 53 and 54. The common electrode 56 commonly or mutually faces the plurality of individual electrodes 55 across the piezoelectric layer 53. While illustration of a specific electrical connection structure is omitted, a connecting terminal is drawn out from the common electrode 56 to the upper surface of the piezoelectric layer 53 and, in the same manner as the plurality of individual electrodes 55, is also connected with the wiring member. Connected with a ground wire formed in the wiring member, the common electrode 56 is constantly maintained at the ground potential.

Further, such portions of the piezoelectric layer 53 as sandwiched between the individual electrodes 55 and the common electrode 56 (to be referred to as active portions 53*a*) are polarized in the direction from the individual electrodes 55 toward the common electrode 56 (downward in the thickness direction). Each of the active portions 53*a* is a part where a piezoelectric deformation (piezoelectric strain) occurs when a potential difference arises between the individual electrodes 55 and the common electrode 56 to bring about an electric field acting in the thickness direction.

An explanation will be made on how the abovementioned piezoelectric actuator 41 operates. When the driver IC 58 applies the drive potential to a certain one of the individual electrodes 55, then the potential difference arises between that individual electrode 55 and the common electrode 56. At this time, the electric filed acts downward on the corresponding active portion 53*a* of the piezoelectric layer 53 where the direction of the electric field is consistent with the polarization direction of the active portion 53*a*. Therefore, the active portion 53*a* contracts in its planar direction and, along with this, the two piezoelectric layers 53 and 54 bend to project toward the pressure chamber 52. By virtue of this, the pressure chamber 52 changes in volume to give rise to a pressure wave in the individual channel including the pressure chamber 52. Thereby, jet energy is imparted to the ink such that droplets of the ink are jetted from the nozzle 47.

<Details of the Nozzle Array>

Figure 5:
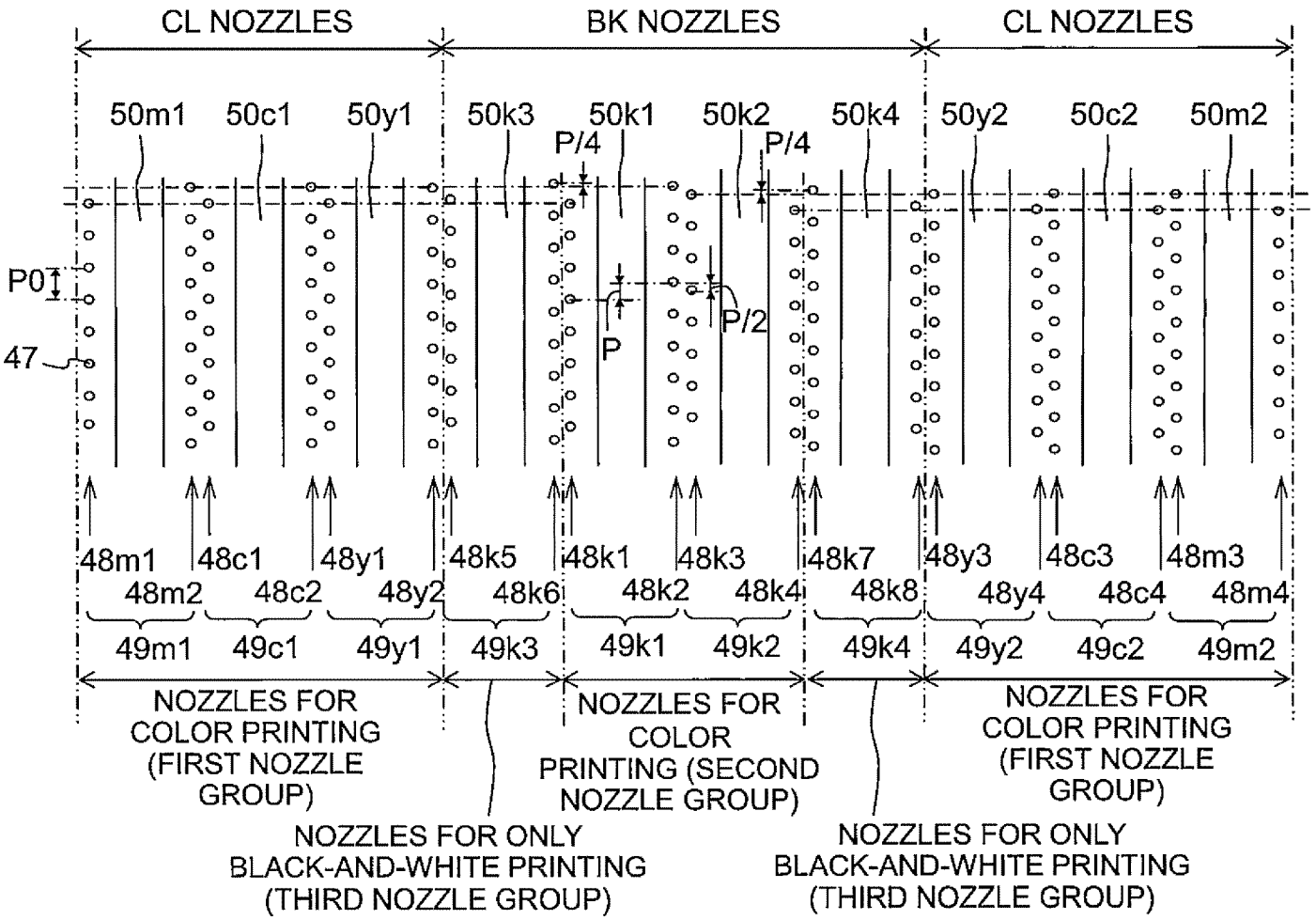
FIG. 5 depicts a nozzle arrayal of the ink jet head of FIG. 3.

Next, a detailed explanation will be made on arraying the plurality of nozzles 47 formed in the nozzle plate 46. The nozzles 47 and the manifolds 50 should have been depicted in FIG. 5 with hidden lines in nature, hut are depicted here with solid lines. As depicted in FIGS. 3 and 5, in the nozzle plate 46, the plurality of nozzles 47 are arrayed along the conveyance direction to form the total 20 nozzle rows 48 aligning in the scanning direction. Further, this embodiment is explained supposing that the plurality of nozzles 47 are arrayed in a direction orthogonal to the scanning direction. However, this is not necessary, and the nozzles 47 may be arrayed in a direction intersecting the scanning direction at an angle other than 90 degrees.

The 20 nozzle rows 48 are formed of eight nozzle rows 48*k*1 to 48*k*8 jetting the black ink, four nozzle rows 48*y*1 to 48*y*4 jetting the yellow ink, four nozzle rows 48*c*1 to 48*c*4 jetting the cyan ink, and four nozzle rows 48*m*1 to 48*m*4 jetting the magenta ink. Further, any two nozzle rows 48 respectively jetting an ink of the same color are arranged on the two opposite sides of one manifold 50 in the scanning direction to interpose the manifold 50 supplying the ink, and connected with the manifold 50. For example, the manifold 50*k*1 for black is connected with the two nozzle rows 48*k*1 and 48*k*2 arranged on the two sides thereof.

Further, in the following explanation, the term "nozzle group 49" is used to refer to a group of the nozzles 47 formed of two nozzle rows 48 which jet an ink of the same color and are arranged to interpose one manifold 50. That is, in the channel structure 40 of the first embodiment, there are four nozzle groups 49*k*1 to 49*k*4 for black, two nozzle groups 49*y*1 and 49*y*2 for yellow, two nozzle groups 49*c*1 and 49*c*2 for cyan, and two nozzle groups 49*m*1 and 49*m*2 for magenta. Between the two nozzle rows 48 forming each one nozzle group 49, the nozzles 47 are dislocated in the conveyance direction by half of an arrival pitch P0 (P0/2=P) of each of the nozzle rows 48. In other words, the nozzles 47 constituting one nozzle group 49 formed of two nozzle rows 48 are arrayed as a whole at the pitch P in the conveyance direction.

The four nozzle groups 49*k*1 to 49*k*4 for black are arranged in the center according to the scanning direction. The two nozzle groups 49*k*1 and 49*k*2 are arranged in the center to align in the left-right direction, on the left side thereof the nozzle group 49*k*3 is arranged, and on the right side thereof the nozzle group 49*k*4 is arranged. The two nozzle groups 49*y*1 and 49*y*2 for yellow are arranged separately on the two sides of the four nozzle groups 49*k*1 to 49*k*4 for black according to the scanning direction to interpose these nozzle groups 49*k*1 to 49*k*4 for black. The two nozzle groups 49*c*1 and 49*c*2 for cyan are arranged further outward on the two sides, and the two nozzle groups 49*m*1 and 49*m*2 for magenta are arranged still further outward on the two sides. That is, the nozzle groups 49 for the color inks of yellow, cyan and magenta are arranged bisymmetrically to interpose the four nozzle groups 49*k* for the black ink according to the scanning direction.

Between the nozzle groups 49*k*1 for black and the nozzle groups 49*y*1, 49*c*1 and 49*m*1 for color on the left side, the respective nozzles 47 are equally positioned according to the conveyance direction which is the arrayal direction of the nozzles 47. Likewise, between the nozzle groups 49*k*2 for black and the nozzle groups 49*y*2, 49*c*2 and 49*m*2 for color on the right side, all the nozzles 47 are also equally positioned. Further, the nozzles 47 forming the nozzle groups 49*k*2, 49*y*2, 49*c*2 and 49*m*2 on the right side are dislocated by P/2 to the downstream side in the conveyance direction, with respect to the nozzle groups 49*k*1, 49*y*1, 49*c*1 and 49*m*1 on the left side. For example, the nozzles 47 forming the nozzle group 49*k*2 are dislocated by P/2 to the downstream side in the conveyance direction with respect to the nozzles 47 forming the nozzle group 49*k*1.

The two nozzle groups 49*k*1 and 49*k*2 for black, which accord with the nozzle groups 49*y*, 49*c* and 491*m* for color in terms of the positions of the nozzles 47, are used simultaneously with the nozzle groups 49*y*, 49*c* and 49*m* for color. That is, the two nozzle groups 49*k*1 and 49*k*2 are usable, too, in full color print of images by using all the four color inks. Of course, the two nozzle groups 49*k*1 and 49*k*2 can also be used in black-and-white print by using the black ink only.

The nozzle group 49*k*3 for black is arranged between the nozzle groups 49*y*1, 49*c*1 and 49*m*1 for color on the left side, and the nozzle group 49*k*1 for black. Further, the nozzle group 49*k*4 for black is arranged between the nozzle groups 49*y*2, 49*c*2 and 49*m*2 for color on the right side, and the nozzle group 49*k*2 for black. In other words, with respect to the nozzle group 49*k*3 for black, the nozzle group 49*y*1 for yellow is arranged on the left side whereas the nozzle group 49*k*1 for black is arranged on the right side. Further, with respect to the nozzle group 49*k*4 for black, the nozzle group 49*y*2 for yellow is arranged on the right side whereas the nozzle group 49*k*2 for black is arranged on the left side.

The nozzles 47 forming the nozzle group 49*k*3 are dislocated by P/4 from those of the nozzle group 49*k*1 to the upstream side in the conveyance direction. Further, the nozzles 47 forming the nozzle group 49*k*4 are dislocated by P/4 from those of the nozzle group 49*k*2 to the upstream side in the conveyance direction. By virtue of this, the nozzles 47, which form the four nozzle groups 49*k*1 to 49*k*4 and jet the black ink, are aligned at the pitch of P/4 in the conveyance direction. Further, between the nozzle groups 49*y*, 49*c* and 49*m* for the color inks and the nozzle groups 49*k*3 and 49*k*4, the nozzles 47 are not located in accordant positions. The nozzle groups 49*k*3 and 49*k*4 are used together with the other nozzle groups 49*k*1 and 49*k*2 for black but not used with the nozzle groups 49*y*, 49*c* and 49*m* for color. That is, the nozzle groups 49*k*3 and 49*k*4 are used exclusively in black-and-white print.

Figure 6:
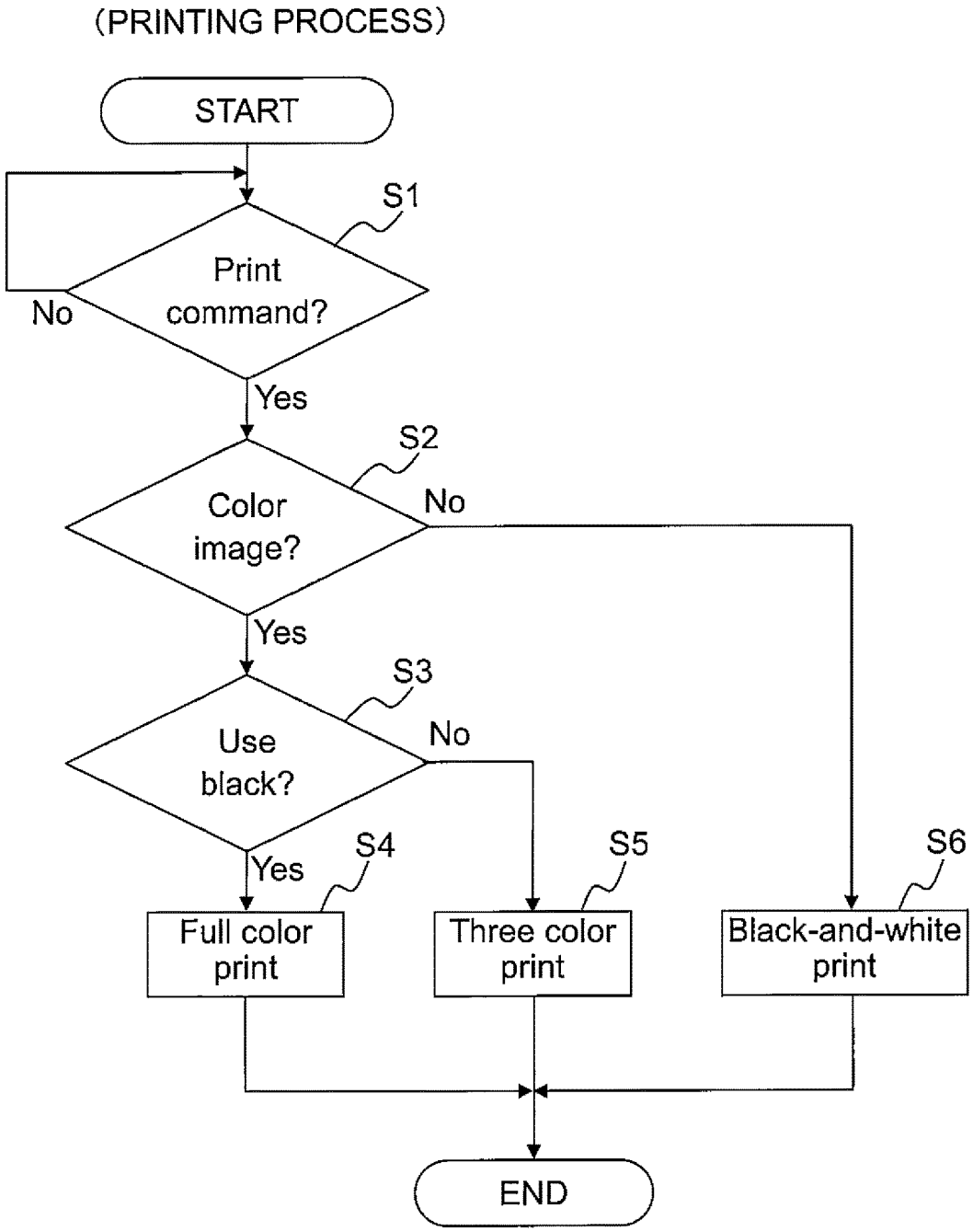
FIG. 6 is a flowchart of printing processes.

Using the ink jet head 5 having the above nozzle array, it is possible for the controller 9 to carry out the following three printing processes on the recording paper 100 according to a print command input from the PC 23 or the like which is an external device. FIG. 6 is a flowchart of the printing processes. Further, in FIG. 6, Si (i=1, 2, 3 . . . ) indicates the number of each step. If the print command is input from the external device PC 23 (S1: Yes), then the controller 9 selects an appropriate printing process from the input print command. This selection of a printing process is carried out, for example, in the following manner. The above print command includes mode information corresponding to a print mode set by a user in the print setting on the PC 23 (for example, photographic print mode, black-and-white print mode, or the like). The controller 9 selects a printing process based on the above mode information included in the print command.

First, it is determined whether or not the mode is to print color image (S2). When the mode is to print color image (S2: Yes), then it is further determined whether or not the black ink is used in the print mode (S3). When the black ink is to be used (S3: Yes), then a process is carried out for full color print (S4). When the black ink is not to be used (S3: No), then a process is carried out for three color print (S5). Further, when the mode is not to print color image (in the case of the black-and-white print mode; S2: No), then a process is carried out for black-and-white print (S6).

<Full Color Print>

In the full color printing, in a leftward moving pass (to be referred to below as forward moving pass), the controller 9 controls the ink jet head 5 to jet the four color inks from the four nozzle groups 49*k*1, 49*y*1, 49*c*1 and 49*m*1 on the left side in which positions of the nozzles 47 are accordant. In a rightward moving pass to be referred to below as backward moving pass), the controller 9 controls the ink jet head 5 to jet the four color inks from the four nozzle groups 49*k*2, 49*y*2, 49*c*2 and 49*m*2 on the right side in which positions of the nozzles 47 are accordant. Further, the controller 9 controls the ink jet head 5 not to jet the ink from the nozzle groups 49*k*3 and 49*k*4 for black in which the positions of the nozzles 47 are different from those of the above nozzle groups 49.

By virtue of this, the ink jet head 5 is caused to move back and forth in the scanning direction while the full color print is carried out on the recording paper 100 with a dot pitch of P/2. In this case, either in the forward moving pass or in the backward moving pass, the order for the eight nozzle groups 49 to jet the four color inks is: M→C→Y→K→K→Y→C→M, thereby equalizing the order of landing the inks on the recording paper 100. In this manner, it is possible to equalize the order of landing the four color inks between the forward moving pass and the backward moving pass. Therefore, it is possible to suppress difference in coloration and improve the image quality.

<Three Color Print>

In the three color printing, in the forward moving pass, the controller 9 controls the ink jet head 5 to jet the three color inks from the nozzle groups 49*y*1, 49*c*1 and 49*m*1 for color on the left side, and in the backward moving pass, the controller 9 controls the ink jet head 5 to jet the three color inks from the nozzle groups 49*y*2, 49*c*2 and 49*m*2 for color on the right side. Further, the controller 9 does not cause the ink to be jetted from the four nozzle groups 49*k*1 to 49*k*4 for black.

<Black-and-white Print>

In the black-and-white printing, the controller 9 controls the carriage 3 to move in the scanning direction while letting the black ink be jetted respectively from the four nozzle groups 49*k*1 to 49*k*4. Of course, no inks are jetted from the nozzle groups 49*y*, 49*c* and 49*m* for color. Here, the nozzles 47 forming the nozzle group 49*k*3 are dislocated from the nozzle group 49*k*1 by P/4 in the conveyance direction. Further, the nozzles 47 forming the nozzle group 49*k*4 are dislocated from the nozzle group 49*k*2 by P/4 in the conveyance direction. Therefore, it is possible for the ink jet head 5 to move in the scanning direction while carrying out the black-and-white print at high resolution with a dot pitch of P/4 (the resolution being twice that for the color print) by jetting the ink respectively from the four nozzle groups 49*k*1 to 49*k*4. Further, while the black-and-white print may be carried out in the form of bidirectional print as with the color print, the black-and-white print may also be carried out in the form of unidirectional print, that is, the ink is jetted only when the carriage 3 is moving in a single direction.

However, when a certain nozzle 47 is caused to jet the ink, heat is produced in the individual electrode 55 and/or active portion 53*a* (see FIGS. 4A and 4B) of the piezoelectric actuator 41 corresponding to that nozzle 47, thereby increasing the temperature of the ink inside the pressure chamber 52. On the other hand, no heat is produced in the above piezoelectric actuator 41 with the nozzles 47 from which no inks are jetted. Thus, when there is a difference in the frequency of jetting the inks between two kinds of different nozzles 47, then a temperature difference arises between the two.

More specifically, in the first embodiment, among the four nozzle groups 49*k* for black, the two nozzle groups 49*k*1 and 49*k*2 are used both in the fill color print and in the black-and-white print whereas the two nozzle groups 49*k*3 and 49*k*4 used exclusively in the black-and-white print are not used in the full color print. Therefore, there is an inclination for the nozzle groups 49*k*3 and 49*k*4 to have a lower ink temperature than the nozzle groups 49*k*1 and 49*k*2. Especially, if the full color print is carried out first and the black-and-white print is carried out next, then in the state right before the black-and-white print, a significant temperature difference is more likely to arise between the nozzle groups 49*k*3 and 49*k*4 not used in the color print and the nozzle groups 49*k*1 and 49*k*2 used in the color print.

In this regard, in the first embodiment, the two nozzle groups 49*k*3 and 49*k*4 used exclusively in the black-and-white print are arranged separately in the scanning direction. On the both sides of the nozzle group 49*k*3, the nozzle group 49*y*1 and the nozzle group 49*k*1 are arranged for use in the full color print. Likewise, on the both sides of the nozzle group 49*k*4, the nozzle group 49*y*2 and the nozzle group 49*k*2 are arranged for use in the full color print. Therefore, when the full color print is carried out and the ink temperatures of the nozzle groups 49*y*1 and 49*y*2 and the nozzle groups 49*k*1 and 49*k*2 increase respectively, then the ink temperature of the nozzle groups 49*k*3 and 49*k*4 interposed therebetween also increases. By virtue of this, because the difference in ink temperature is reduced between the four nozzle groups 49*k* when starting the black-and-white print, the difference in ink jet amount is also reduced between those groups, thereby suppressing the density unevenness in images.

Further, in the first embodiment, the two nozzle groups 49*k*3 and 49*k*4 for black are arranged separately on the left and right sides of the two nozzle groups 49*k*1 and 49*k*2 for black. Further, the two nozzle groups 49*y*1 and 49*y*2 for yellow, the two nozzle groups 49*c*1 and 49*c*2 for cyan, and the two nozzle groups 49*m*1 and 49*m*2 for magenta are arranged separately on the left and right sides of the four nozzle groups 49*k*1 to 49*k*4 for black. That is, the nozzle groups 49*y*, 49*c* and 49*m* for the color inks of yellow, cyan and magenta are arranged bisymmetrically according to the scanning direction to interpose the nozzle groups 49*k* for the black ink. Therefore, when the full color print is carried out bidirectionally, the order of landing the four color inks is equalized between the forward moving pass and the backward moving pass, thereby suppressing the difference in coloration such that a very high image quality is obtained. On the other hand, because the four nozzle groups 49*k* for black are arranged to concentrate in the center, the carriage 3 is subjected to a small scanning range in the black-and-white print. Hence, the time needed for one pass is reduced such that it is possible to shorten the print time.

Between the nozzle groups 49*y*1, 49*c*1 and 49*m*1 for color and the nozzle group 49*k*1 for black on the left side, the nozzles 47 are located in accordant positions, while between the nozzle groups 49*y*2, 49*c*2 and 49*m*2 for color and the nozzle group 49*k*2 for black on the right side, the nozzles 47 are also located in accordant positions. On the other hand, between the nozzle group 49*k*1 and nozzle group 49*k*3 for black, the nozzles 47 are dislocated by P/4, while between the nozzle group 49*k*2 and nozzle group 49*k*4 for black, the nozzles 47 are also dislocated by P/4. Therefore, in the black-and-white print using the four nozzle groups 49*k*1 to 49*k*4 for black, it is possible to print at a higher resolution than in the full color print.

Figure 7A:
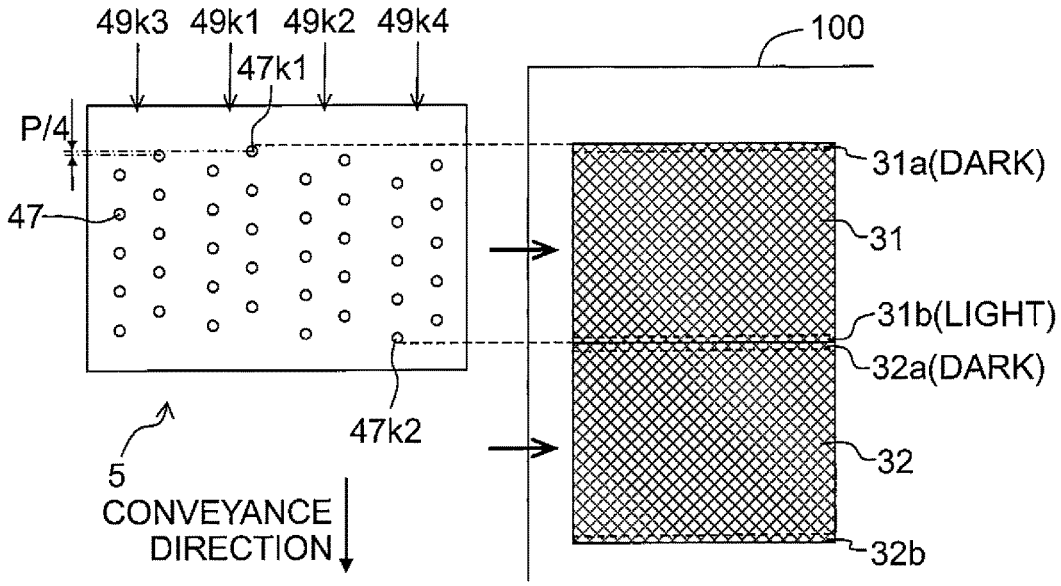
Figure 7B:
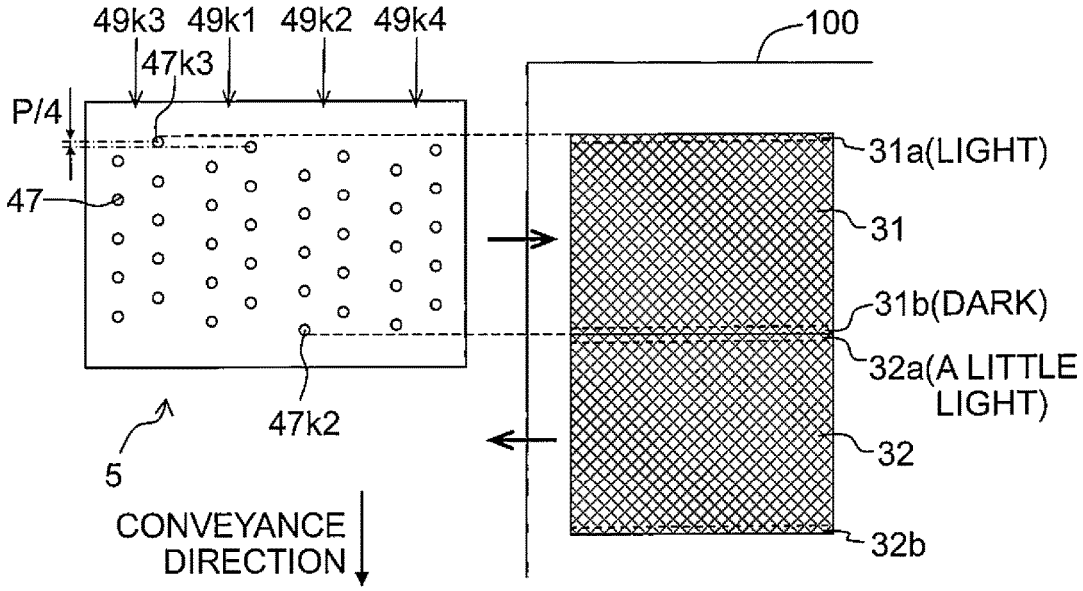

The nozzle groups 49*k*3 and 49*k*4 may be dislocated with respect to the nozzle groups 49*k*1 and 49*k*2 either to the upstream side or to the downstream side in the conveyance direction. In the first embodiment, however, a configuration of upstream dislocation in the conveyance direction is adopted for the following reasons. FIGS. 7A and 7B are explanatory diagrams for an image print, wherein FIG. 7A shows a configuration that the nozzle groups 49*k*3 and 49*k*4 are dislocated downstream by P/4 in the conveyance direction from the nozzle groups 49*k*1 and 49*k*2, whereas FIG. 7B shows a configuration that the same nozzle groups are dislocated upstream by P/4 in the conveyance direction.

As described above, the nozzle groups 49*k*3 and 49*k*4 are more likely to have a lower ink temperature than the nozzle groups 49*k*1 and 49*k*2. Hence, the nozzles 47 of the nozzle groups 49*k*3 and 49*k*4 are also more likely to jet less amount of the ink. Further, because the nozzle groups 49*k*3 and 49*k*4 used exclusively in the black-and-white print have a low ink jet frequency, the ink inside the nozzles 47 may advance in thickening. From this regard, too, the nozzles 47 are inclined to jet less amount of the ink.

As depicted in FIG. 7A, when the nozzles 47 of the nozzle groups 49*k*3 and 49*k*4 are dislocated to the downstream side in the conveyance direction, with respect to the nozzle groups 49*k*1 and 49*k*2, then the terminatory nozzle 47*k*4 of the nozzle group 49*k*4 is located on the downstream side from the nozzle groups 49*k*1 and 49*k*2 in the conveyance direction. In this case, the terminatory nozzle 47*k*4 of the nozzle group 49*k*4 is used to form such a downstream edge portion 31*b* of an image part 31 formed on the recording paper 100 through the first pass of the carriage 3, thereby producing a light color. On the other hand, the terminatory nozzle 47*k*1 of the nozzle group 49*k*1 is used to form such an upstream edge portion 31*a* of the image part 31, thereby producing a dark color. Therefore, when printing image on the recording paper 100 through two passes, the light colored downstream edge portion 31*b* of the image part 31 formed through the first pass is adjacent to a dark-colored upstream edge portion 32*a* of an image part 32 funned through the second pass. If there is a great difference in the color density, then unevenness in the density is recognized in the shape of a band.

In contrast to this as depicted in FIG. 7B, when the nozzles 47 of the nozzle groups 49*k*3 and 49*k*4 are dislocated to the upstream side in the conveyance direction with respect to the nozzle groups 49*k*1 and 49*k*2, then the terminatory nozzle 47*k*3 of the nozzle group 49*k*3 is located on the upstream side from the nozzle groups 49*k*1 and 49*k*2 in the conveyance direction. In this case, the terminatory nozzle of the nozzle group 49*k*3 is used to form the upstream edge portion 31*a* of the image part 31 formed on the recording paper 100 through the first pass of the carriage 3, thereby producing a light color, On the other hand, the terminatory nozzle 47*k*2 of the nozzle group 49*k*2 is used to form the downstream edge portion 31*b* of the image part 31, thereby producing a dark color.

However, because the upstream edge portion 311*a* of the image part 31 formed through the first pass is not adjacent to image parts formed through other passes, even if the upstream edge portion 31*a* is more or less light colored, there is still no influence on the image quality. Further, in the second and succeeding passes, improvement is made in the jet conditions for the nozzle groups 49*k*3 and 49*k*4 (the ink temperature and the degree of ink thickening) due to the ink jetting in the previous pass, thereby reducing the difference in the amount of ink jet between the nozzle groups 49*k*3 and 49*k*4 and the nozzle groups 49*k*1 and 49*k*2.

In the first embodiment explained above, the controller 9 corresponds to the "control portion" of the present teaching. The scanning direction corresponds to the "first direction" of the present teaching whereas the conveyance direction corresponds to the "second direction" of the present teaching. The color inks (yellow, magenta and cyan) correspond to the "first color" of the present teaching whereas the black ink corresponds to the "second color" of the present teaching. The nozzle groups 49*y*, 49*c* and 49*m* for color correspond to the "first nozzle groups" of the present teaching. The nozzle groups 49*k*1 and 49*k*2 for black correspond to the "second nozzle groups" of the present teaching whereas the nozzle groups 49*k*3 and 49*k*4 for black correspond to the "third nozzle groups" of the present teaching. The process for the full color print corresponds to the "first printing process" of the present teaching. The process for the black-and-white print corresponds to the "second printing process" of the present teaching.

Next, explanations will be made on several modifications of the first embodiment. However, the same reference signs are assigned to the components identical or similar in configuration to those in the first embodiment, and any explanation therefor will be omitted as appropriate.

<First Modification>

The nozzle groups 49 for the four color inks are not limited to the arrangement relationship in the scanning direction according to the first embodiment, but can be changed as follows for example.

Figure 8:
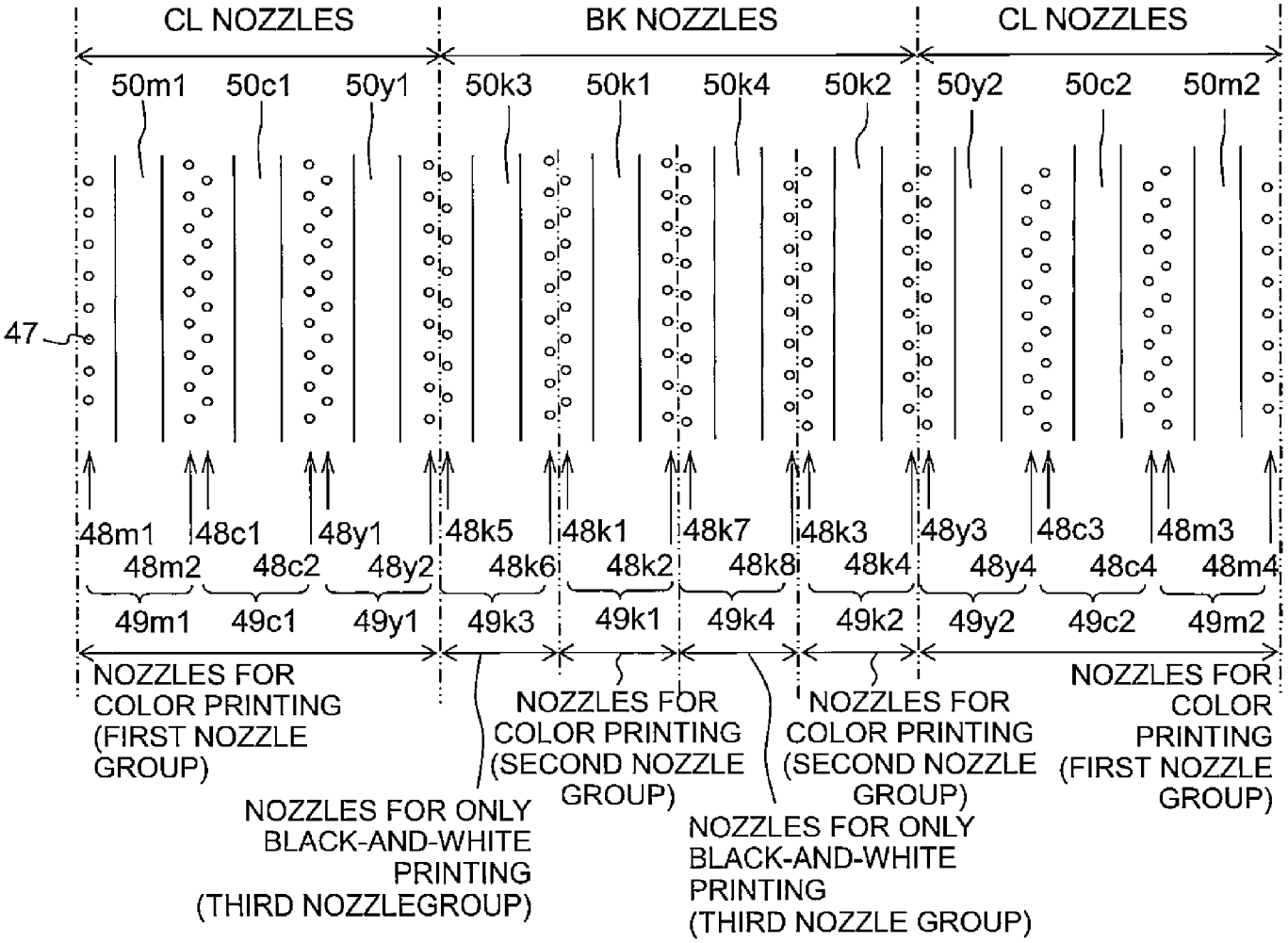
FIG. 8 shows a nozzle arrayal of an ink jet head according to a modification of the first embodiment.

In FIGS. 3 and 5 of the first embodiment, the nozzle groups 49*k*1 and 49*k*2 are arranged adjacently and, on the two sides thereof the nozzle groups 49*k*3 and 49*k*4 are arranged separately. In contrast to this, as depicted in FIG. 8, the two nozzle groups 49*k*1 and 49*k*2 also used in the full color print and the two nozzle groups 49*k*3 and 49*k*4 used exclusively in the black-and-white print may be arranged alternately in the scanning direction. In such a configuration, the nozzle group 49*k*3 is interposed between the nozzle group 49*k*1 for black and the nozzle group 49*y*1 for yellow, while the nozzle group 49*k*4 is interposed between the two nozzle groups 49*k*1 and 49*k*2 for black.

In the above first embodiment, the four nozzle groups 49*k* for black are located in the center according to the scanning direction and, on the two left and right sides thereof, the nozzle groups 49*y*, 49*c* and 49*m* for color are arranged separately. However, the arrangement relationship between black and color may be reversed. That is, the nozzle groups 49*y*, 49*c* and 49*m* for the three colors may be arranged to concentrate in the center according to the scanning direction and, on the left and right two sides thereof, the nozzle groups 49*k* for black are arranged separately. Alternatively, parts of the four nozzle groups 49*k* for black may be arranged between the nozzle groups 49*y*, 49*c* and 49*m* for the three colors.

Figure 9:
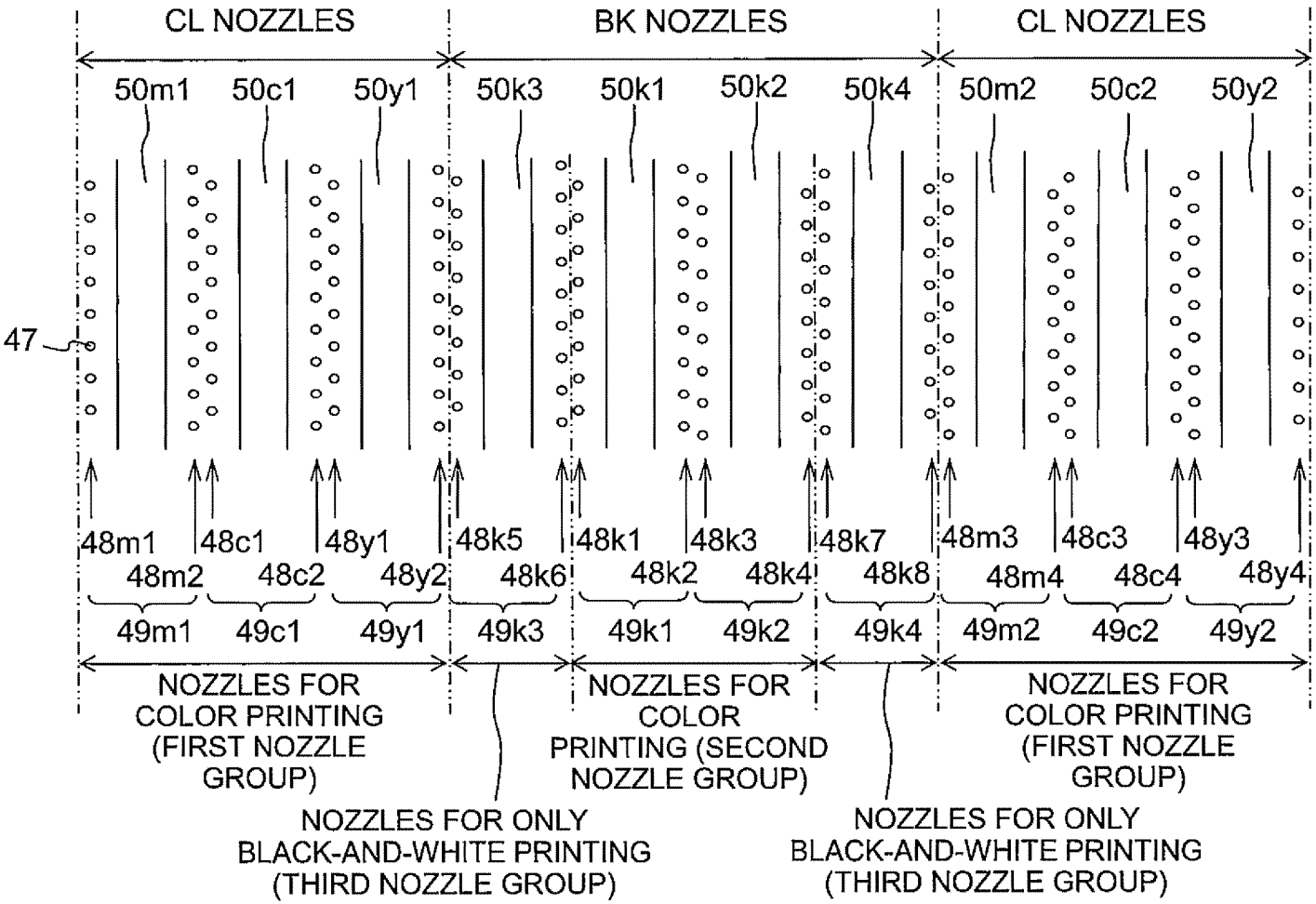
FIG. 9 shows a nozzle arrayal of an ink jet head according to another modification.
Figure 10:
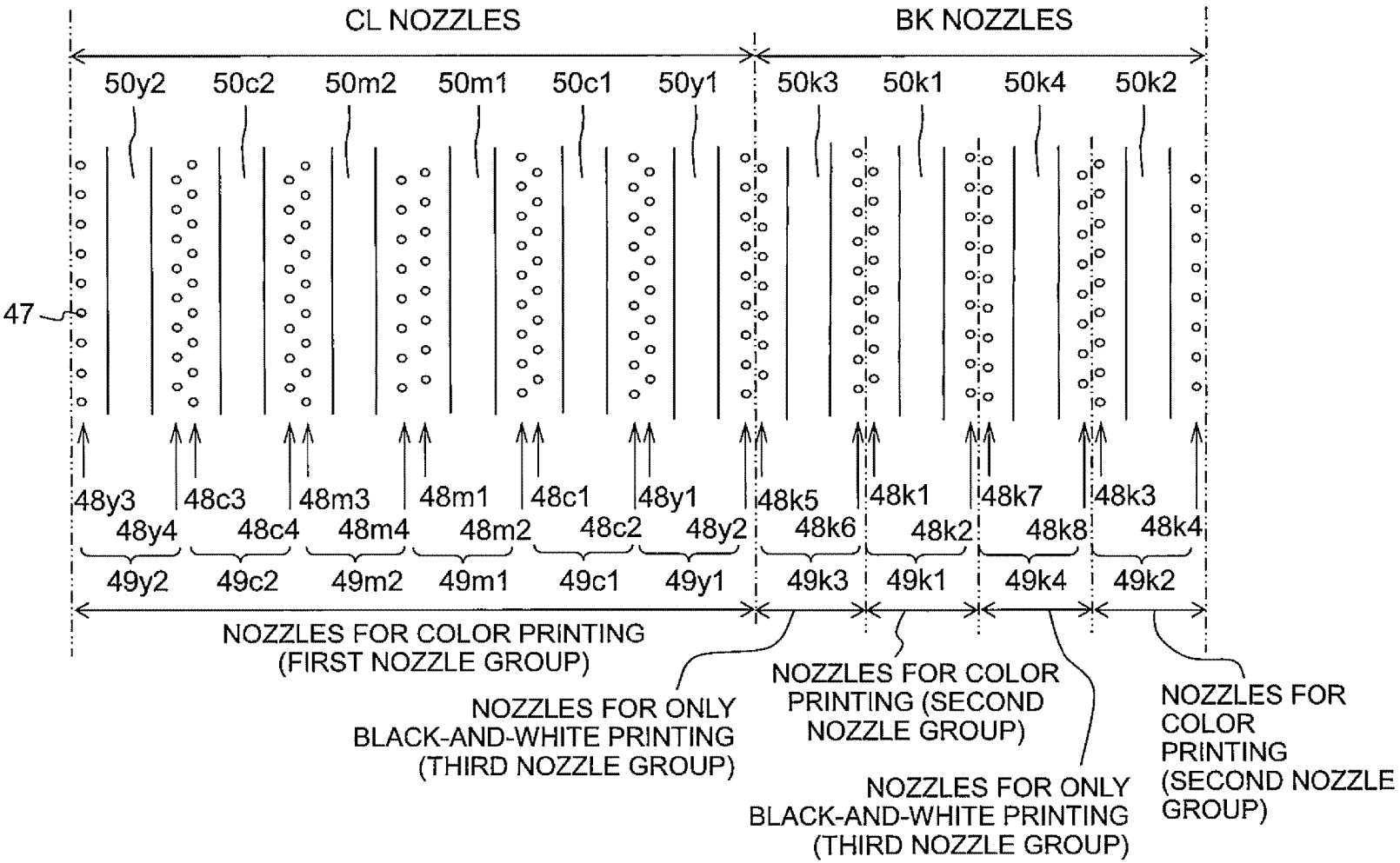
FIG. 10 shows a nozzle arrayal of an ink jet head according to still another modification.

The nozzle groups 49 for the four colors need not necessarily be arranged symmetrically in the scanning direction. As depicted in FIG. 9 for example, the nozzle groups 49*y*, 49*c* and 49*m* for the three colors may align in the order of M→C→Y from the left both on the left side and the right side of the nozzle groups 49*k* for black. Alternatively, as depicted in FIG. 10, the four nozzle groups 49*k* for black may be arranged to concentrate adjacently in the scanning direction and the nozzle groups 49*y*, 49*c* and 49*m* for the three colors may also be arranged to concentrate adjacently in the scanning direction such that the four nozzle groups 49*k* for black and the total six nozzle groups 49 (49*v*, 49*c* and 49*m*) for color are arranged to align in the scanning direction.

<Second Modification>

Figure 11:
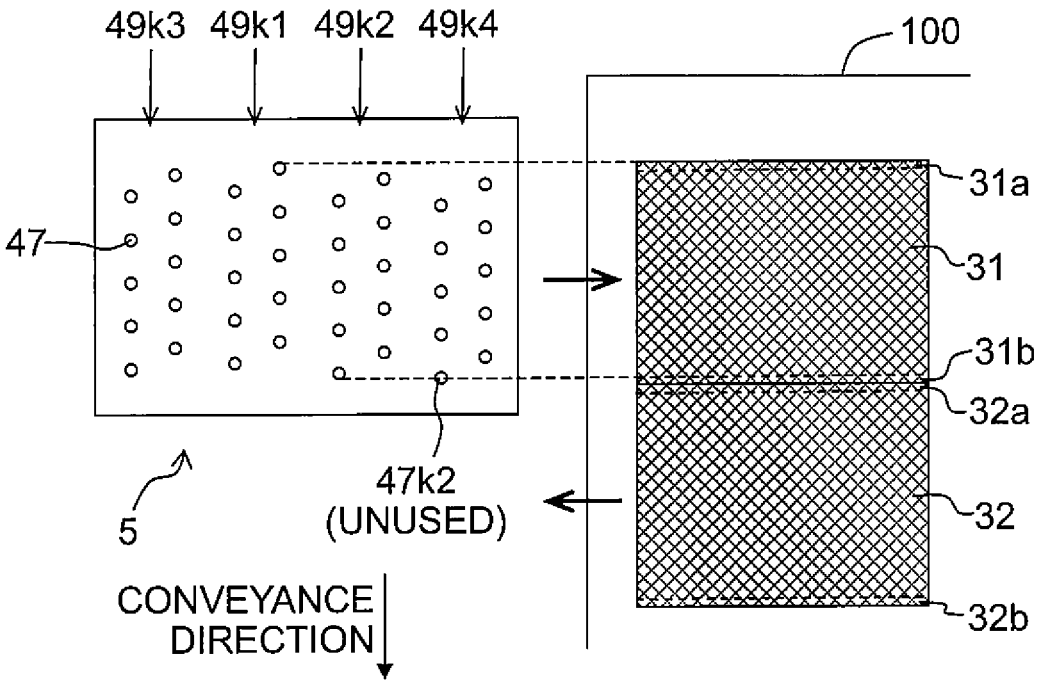
FIG. 11 is an explanatory diagram for an image print according to still another modification.

As also explained with FIGS. 7A an 7B of the first embodiment, less amount of the inks is jetted from the respective nozzles 47 of the nozzle groups 49*k*3 and 49*k*4 used exclusively in the black-and-white print than those of the nozzle groups 49*k*1 and 49*k*2 also used in the full color print. This is the factor for the unevenness in color density to occur in the border part of the image parts formed through two passes. Hence, among the nozzles 47 forming the nozzle groups 49*k*3 and 49*k*4, the terminatory nozzles 47 located beyond the nozzle groups 49*k*1 and 49*k*2 in the conveyance direction may not be caused to jet the ink. In FIG. 11, because the nozzle groups 49*k*3 and 49*k*4 are dislocated to the downstream side in the conveyance direction with respect to the nozzle groups 49*k*1 and 49*k*2, the terminatory nozzle 47*k*4 of the nozzle group 49*k*4 is located beyond the nozzle groups 49*k*1 and 49*k*2 to the downstream side in the conveyance direction. Hence, the terminatory nozzle 47*k*4 is not caused to jet the ink. By virtue of this, the nozzles 47 of the nozzle group 49*k*1 are used to form the upstream edge portion 31*a* of the image part 31 formed through the first pass while the nozzles 47 of the nozzle group 49*k*2 are used to form the downstream edge portion 31*b* of the image part 31. By virtue of this, it is possible to suppress the density unevenness in the border parts of the two image parts 31 and 32 formed respectively through two passes.

<Third Modification>

In the above first embodiment, there are respectively two first groups for the color inks, two second nozzle groups for black used in the full color print, and two third nozzle groups for black used exclusively in the black-and-white print. However, the number of the first nozzle groups, the second nozzle groups and the third nozzle groups may be three or more, respectively.

<Fourth Modification>

In the above first embodiment, the ink jet head 5 includes the piezoelectric actuator 41 configured for applying a jet pressure to the inks. However, the ink jet head 5 is not limited to inclusion of the piezoelectric actuator 41. For example, the ink jet head 5 may include a heating element for heating the inks to cause film boiling as a configuration for applying the jet pressure to the inks. In this case, too, if the frequency of ink jet is different between different kinds of the nozzles 47, then the heating element heats the inks at different frequencies, thereby causing difference in ink temperature between the above nozzles 47. Therefore, it is possible to preferably adopt the present teaching which is capable of suppressing the difference in ink temperature.

<Second Embodiment>

Next, a second embodiment of the present teaching will be explained. As with the first embodiment, the second embodiment is also an example of applying the present teaching to a printer having a serial ink jet head moving in the scanning direction. While the printer in the second embodiment is different in configuration of the ink jet head from the printer in the first embodiment, the other configurations are all the same. Therefore, the same reference signs are assigned to the components other than the ink jet head as those in the first embodiment, and any explanation therefor will be omitted.

Figure 12:
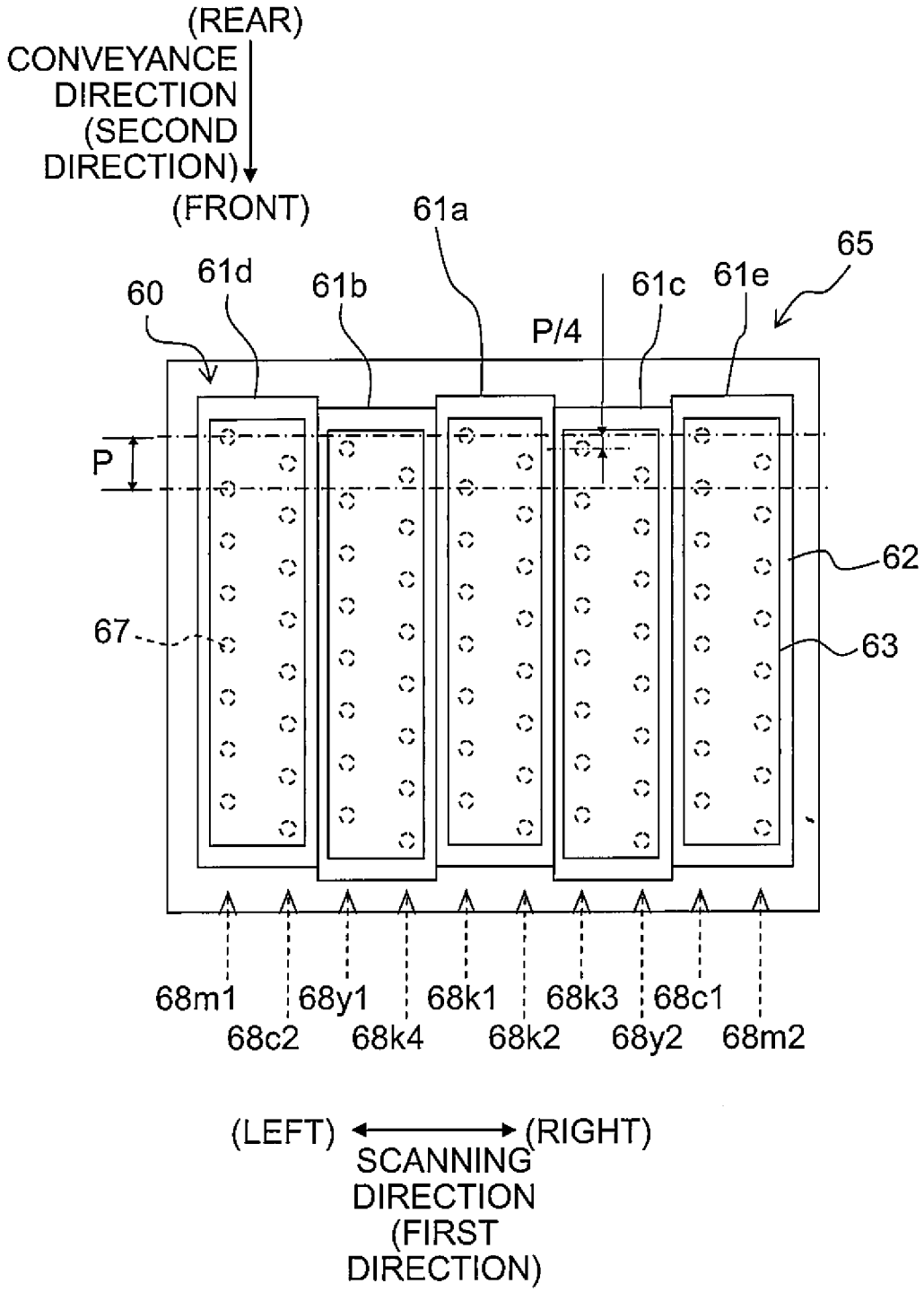
FIG. 12 is a top view of an ink jet head according to a second embodiment of the present teaching.

As depicted in FIG. 12, an ink jet head 65 includes five head units 61 aligning in the scanning direction, and a holding member 60 holding the five head units 61. The five head units 61 have the same structure. That is, the five head units 61 have the same outer shape, the same shape of their inner ink channels, and the like.

Each of the head units 61 has a channel unit 62, and a piezoelectric actuator 63 provided in the channel unit 62. Each channel unit 62 has two nozzle rows 68 which are formed from nozzles 67 arrayed at pitches P in the conveyance direction, and aligned in the scanning direction. Further, between any two of the nozzle rows 68, the nozzles 67 are dislocated by half the pitch P (P/2) in the conveyance direction.

Among the five head units 61, the first head unit 61*a* is located in the center according to the scanning direction. With respect to the first head unit 61*a* in the center, the second head unit 61*b* on the left side and the third head unit 61*c* on the right side are dislocated by P/4 to the downstream side in the conveyance direction. Further, the second head unit 61*b* and the third head unit 61*c* are located in accordant positions according to the conveyance direction. Further, the first head unit 61*a* in the center accords in the position according to the conveyance direction with the fourth head unit 61*d* located on the left side and with the fifth head unit 61*e* located on the right side, of the above three head units 61*a*, 61*b* and 61*c*.

The two nozzle rows 68 (68*k*1 and 68*k*2) of the first head unit 61*a* serve to jet the black ink. The nozzle row 68 (68*k*4) at the inner side (right side) of the second head unit 61*b* and the nozzle row 68 (68*k*3) at the inner side (left side) of the third head unit 61*c* also serve to jet the black ink. Further, the nozzle row 68 (68*y*1) at the outer side (left side) of the second head unit 61*b* and the nozzle row 68 (68*y*2) at the outer side (right side) of the third head unit 61*c* serve to jet the yellow ink.

The nozzle row 68 (68*c*2) at the inner side (right side) of the fourth head unit 61*d* and the nozzle row 68 (68*c*1) at the inner side (left side) of the fifth head unit 61*e* serve to jet the cyan ink. The nozzle row 68 (68*m*1) at the outer side (left side) of the fourth head unit 61*d* and the nozzle row 68 (68*m*2) at the outer side (right side) of the fifth head unit 61*e* serve to jet the magenta ink. By virtue of this, in the ink jet head 65 as a whole, the two nozzle rows 68*y*1 and 68*y*2 for yellow, the two nozzle rows 68*c*1 and 68*c*2 for cyan, and the two nozzle rows 68*m*1 and 68*m*2 for magenta are arranged bisymmetrically in the scanning direction to interpose the four nozzle rows 68*k*1, 68*k*2, 68*k*3 and 68*k*4 for the black ink.

The first head unit 61*a*, fourth head unit 61*d*, and fifth head unit 61*e* are located in accordant positions according to the conveyance direction. Therefore, the nozzles 67 forming the two nozzle rows 68 are located in accordant positions among the first head unit 61*a*, the fourth head unit old, and the fifth head unit 61*e*.

On the other hand, the second head unit 61*b* and third head unit 61*c* are dislocated by P/4 to the downstream side in the conveyance direction, with respect to the first head unit 61*a*. Therefore, the nozzle row 68*k*1 of the first head unit 61*a* is dislocated by P/4 from the nozzle row 68*k*3 for black of the third head unit 61*c* to the downstream side in the conveyance direction, and the nozzle row 68*k*2 of the first head unit 61*a* is also dislocated by P/4 from the nozzle row 68*k*4 for black of the second head unit 61*b* to the downstream side in the conveyance direction. Further, the nozzle row 68*y*1 for yellow of the second head unit 61*b* is dislocated by P/4 to the downstream side in the conveyance direction, with respect to the nozzle row 68*c*1 for cyan of the fifth head unit 61*e* and the nozzle row 68*m*1 for magenta of the fourth head unit old. Likewise, the nozzle row 68*y*2 for yellow of the third head unit 61*c* is also dislocated by P/4 to the downstream side in the conveyance direction, with respect to the nozzle row 68*c*2 for cyan of the fourth head unit 61*d* and the nozzle row 68*m*2 for magenta of the fifth head unit 61*e*.

In the same manner as in the first embodiment, the controller 9 of the printer of the second embodiment controls the ink jet head 65 mentioned above to carry out the full color print, the three color print, or the black-and-white print. In the full color print, the inks are jetted respectively from the nozzle rows 68*k*1 and 68*k*2 for black of the first head unit 61*a*, the nozzle rows 68*y*1 and 68*y*2 for yellow of the second head unit 61*b* and third head unit 61*c*, the nozzle rows 68*c*1 and 68*c*2 for cyan of the fourth head unit Old and fifth head unit 61*e*, and the nozzle rows 68*m*1 and 68*m*2 for magenta of the fourth head unit 61*d* and fifth head unit Ole. On the other hand, in the black-and-white print, the ink is jetted respectively from the nozzle rows 68*k*1 and 68*k*2 for black of the first head unit 61*a* and the nozzle rows 68*k*3 and 68*k*4 for black of the second head unit 61*b* and third head unit 61*c*.

That is, in the second embodiment, the outer nozzle row 68*y*1 of the second head unit 61*b*, the outer nozzle row 68*y*2 of the third head unit 61*c*, the nozzle rows 68*c*2 and 68*m*1 of the fourth head unit 61*d*, and the nozzle rows 68*c*1 and 68*c*2 of the fifth head unit 61*e* correspond respectively to the "first nozzle groups" of the present teaching. The nozzle rows 68*k*1 and 68*k*2 of the first head unit 61*a*, which are used simultaneously with the nozzle rows 68*y*, 68*c* and 68*m* for color in the full color print, correspond to the "second nozzle groups" of the present teaching. Further, the inner nozzle row 68*k*4 of the second head unit 61*b* and the inner nozzle row 68*k*3 of the third head unit 61*c*, which are not used simultaneously with the nozzle rows 68*y*, 68*c* and 68*m* for the color inks, correspond to the "third nozzle groups" of the present teaching.

As described above, the second head unit 61*b* and the third head unit 61*c* are dislocated respectively by P/4 in the conveyance direction, with respect to the first head unit 61*a*. Therefore, the nozzle row 68*k*3 of the third head unit 61*c* is dislocated by P/4 in the conveyance direction with respect to the nozzle row 68*k*1 of the first head unit 61*a*, while the nozzle row 68*k*4 of the second head unit 61*b* is dislocated by P/4 in the conveyance direction with respect to the nozzle row 68*k*2 of the first head unit 61*a*, By virtue of this, the nozzles 67 are dislocated by P/4 in the conveyance direction between the four nozzle rows 68*k*1 to 68*k*4 for black. Hence, it is possible to carry out the black-and-white print at twice the resolution of one head unit 61.

Further, the second head unit 61*b* and the third head unit 61*c* are also dislocated in the conveyance direction with respect to the fourth head unit 61*d* and the fifth head unit 61*e*. Therefore, the nozzles 67 forming the nozzle rows 68*y*1 and 68*y*2 for yellow are dislocated in the conveyance direction with respect to the nozzle rows 68*c*1 and 68*c*2 for cyan and the nozzle rows 68*m*1 and 68*m*2 for magenta. Hence, in the full color print, the positions of landing the yellow ink are dislocated from the positions of landing the three color inks of black, cyan and magenta.

In other words, when the second head unit 61*b* and the third head unit 61*c* are dislocated from the first head unit 61*a*, then the outer nozzle rows 68 of the second head unit 61*b* and the third head unit 61*c* are also dislocated, thereby decreasing the color image quality. In order to prevent as much as possible the image quality from decreasing, it is preferable to let the outer nozzle rows 68 of the second head unit 61*b* and the third head unit 61*c* jet the light colored yellow ink.

Next, a few modifications of the second embodiment will be explained. However, the same reference signs are assigned to the components identical or similar in configuration to those in the second embodiment, and any explanation therefor will be omitted as appropriate.

<First Modification>

Figure 13:
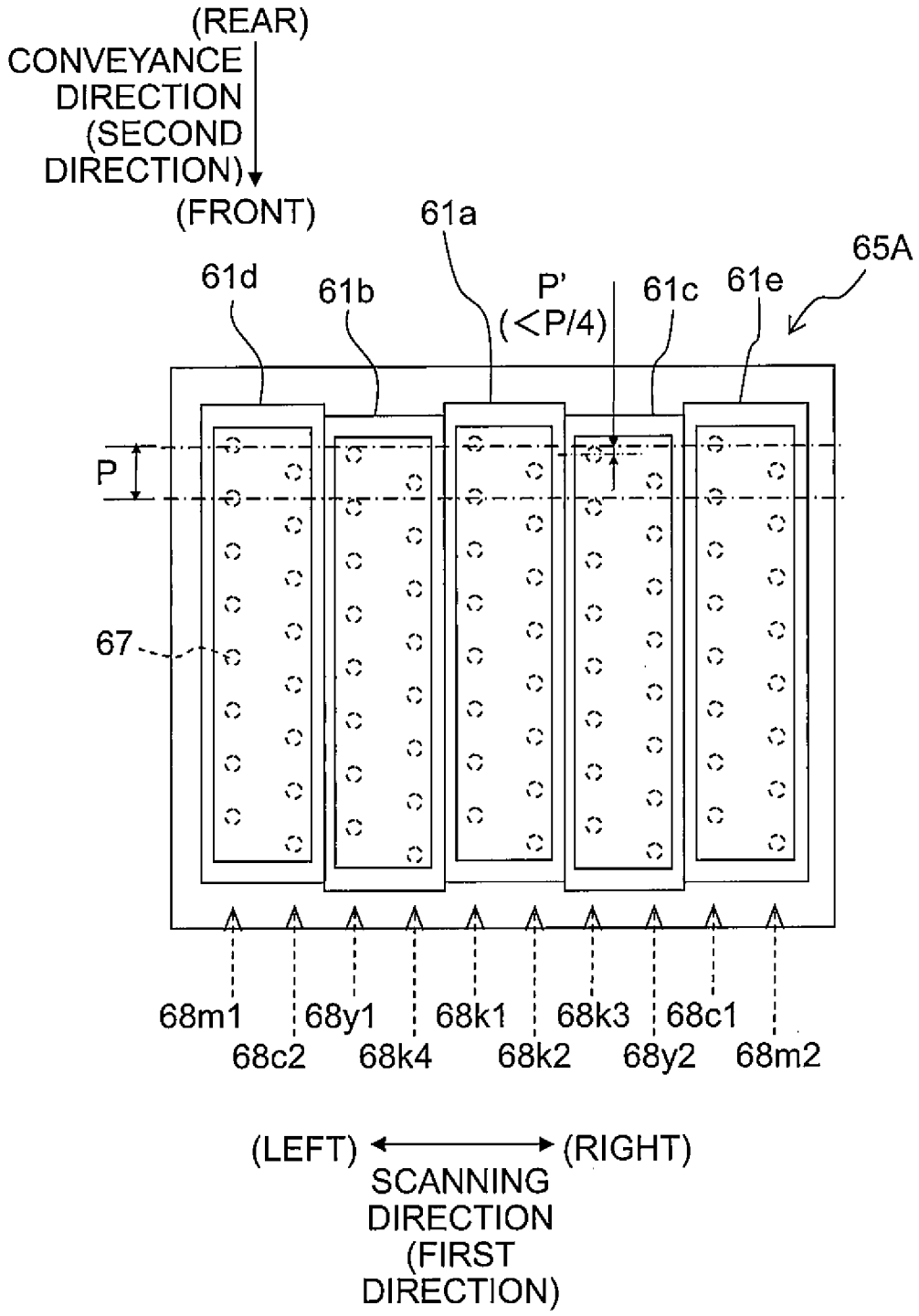
FIG. 13 is a top of an ink jet head according to a modification of the second embodiment.

As with an ink jet head 65A depicted in FIG. 13, less amount of dislocation P' than P/4 may be applied to the second head unit 61*b* and the third head unit 61*c* with respect to the first head unit 61*a*.

<Second Modification>

Figure 14:
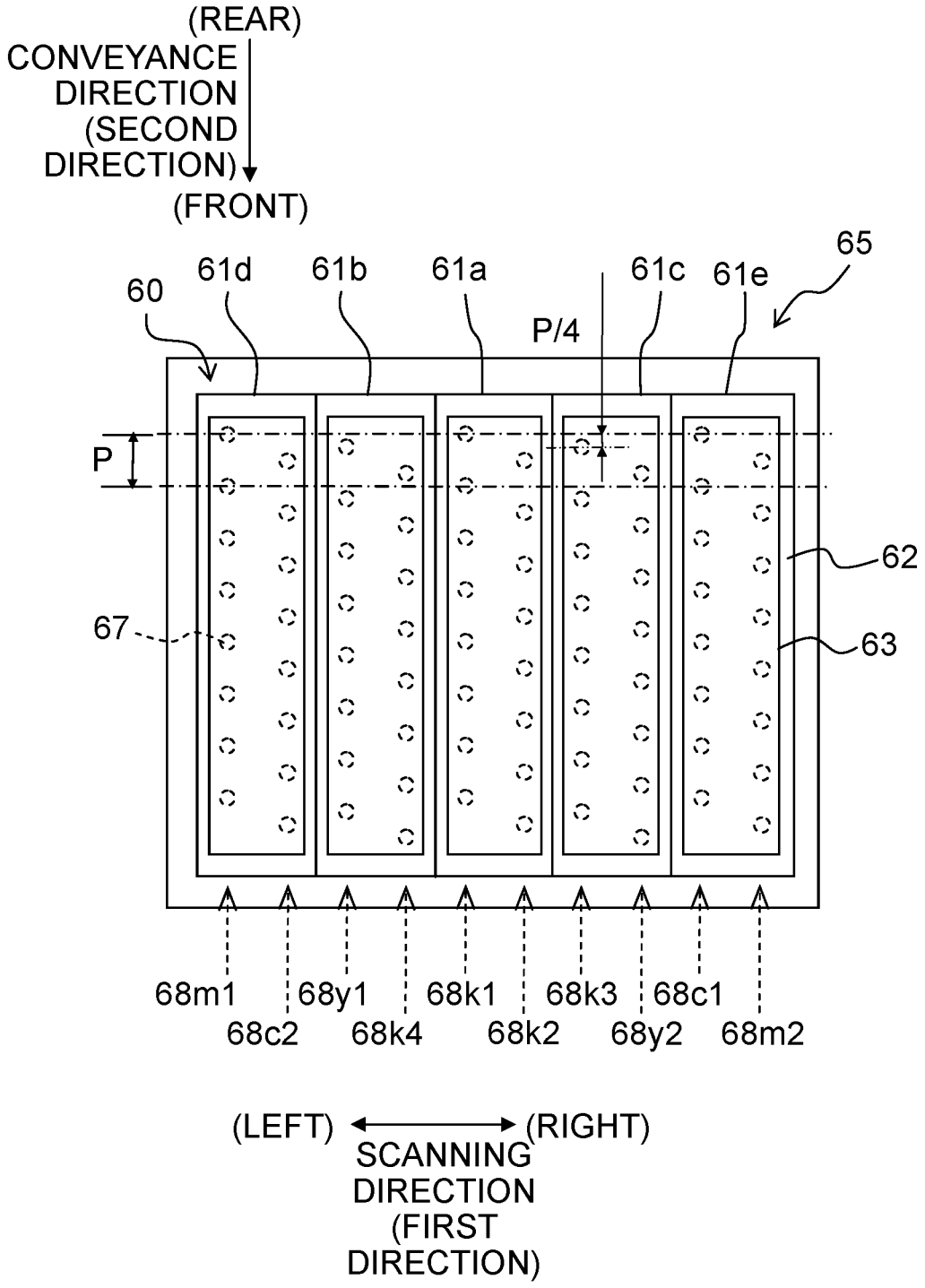
FIG. 14 is a top view of an ink jet head according to another modification.

As with an ink jet head 65B depicted in FIG. 14, the five head units 61 may be all located in accordant positions according to the conveyance direction. In this case, the nozzles 67 are located in accordant positions between the nozzle row 68*k*1 of the first head unit 61*a* and the nozzle row 68*k*3 of the third head unit 61*c* and, furthermore, the nozzles 67 are located in accordant positions between the nozzle row 68*k*2 of the first head unit 61*a* and the nozzle row 68*k*4 of the second head unit 61*b*. In this configuration, it is possible to carry out the black-and-white print at a high speed.

<Third Modification>

It is possible to appropriately change the arrangement relation between the nozzle rows 68 for the four colors. For example, the nozzle rows 68*y*, 68*c* and 68*m* for color may be arranged in the center according to the scanning direction while the nozzle rows 68*k* for black are arranged on the outer sides. Further, it is not necessary to arrange the nozzle rows 68 for the four colors bisymmetrically but the nozzle rows 68 for some colors may be arranged asymmetrically.

<Fourth Modification>

The number of head units 61 is not limited to five but it is possible to appropriately change the number of head units 61 according to the types of ink. For example, if two types of ink are used, then the three of the first head unit 61*a*, second head unit 61*b* and third head unit 61*c* may suffice whereas the fourth head unit 61*d* and fifth head unit 61*e* are not needed.

The embodiments and their modifications explained above have applied the present teaching to an ink jet printer configured to print image and the like by jetting ink to recording paper. However, it is also possible to apply the present teaching to any liquid jet apparatuses used for various purposes other than printing image and the like. For example, it is also possible to apply the present teaching to liquid jet apparatuses and the like for industrial use which jet an electroconductive liquid to a substrate to form an electroconductive pattern on a surface of the substrate.

What is claimed is:

1. An ink jet printer comprising:

a carriage configured to move in a first direction; and an ink jet head mounted on the carriage, and including two first nozzle groups to jet non-black ink, two second nozzle groups to jet black ink, and two third nozzle groups to jet the black ink;

wherein each of the first nozzle groups includes a plurality of nozzles arrayed at a pitch P along a second direction intersecting the first direction, each of the second nozzle groups includes a plurality of nozzles arrayed at the pitch P along the second direction, and each of the third nozzle groups includes a plurality of nozzles arrayed at the pitch P along the second direction; and wherein positions of the nozzles of the second nozzle groups are coincident with those of the nozzles of the first nozzle groups in the second direction;

wherein positions of the nozzles of the third nozzle groups are dislocated respectively from those of the nozzles of the second nozzle groups in the second direction;

wherein one of the second nozzle groups is arranged, in the first direction, between the two of the third nozzle groups;

wherein the two of the third nozzle groups are arranged, in the first direction, between two nozzle groups from among the two of the first nozzle groups and the other of the second nozzle groups; and wherein no nozzle for jetting ink other than the black ink is arranged between one of the third nozzle groups and the other of the third nozzle groups, in the first direction.

2. The ink jet printer according to claim 1;

wherein one of the two third nozzle groups is arranged on one side of the two second nozzle groups in the first direction, and the other of the two third nozzle groups is arranged on the other side of the two second nozzle groups in the first direction; and wherein one of the two first nozzle groups is arranged on one side of the two second nozzle groups and the two third nozzle groups in the first direction, and the other of the two first nozzle groups is arranged on the other side of the two second nozzle groups and the two third nozzle groups in the first direction.

3. The ink jet printer according to claim 2;

wherein the ink jet head includes first, second and third head units, the first head unit being located between the second and third head unit in the first direction;

wherein each of the first, second and third head units includes two nozzle rows arranged side by side in the first direction, each of the nozzle rows including the nozzles arrayed at the pitch P in the second direction;

wherein the two nozzle rows of the first head unit are the two second nozzle groups;

wherein an inner nozzle row of the two nozzle rows in the second head unit in the first direction and an inner nozzle row of the two nozzle row in the third head unit in the first direction are the third nozzle groups; and wherein an outer nozzle row of the two nozzle rows in the second head unit in the first direction and an outer nozzle row of the two nozzle row in the third head unit in the first direction are the first nozzle groups.

4. The ink jet printer according to claim 3;

wherein the ink jet head further includes a fourth head unit arranged on one side of the first, second and third head units in the first direction, and a fifth head unit arranged on the other side of the first, second and third head units in the first direction; and wherein each of the nozzle rows of the fourth head unit and the fifth head unit are the first nozzle groups.

5. The ink jet printer according to claim 4;

wherein the first to fifth head units are located in accordant positions in the second direction.

6. The ink jet printer according to claim 4;

wherein the first head unit, the fourth head unit, and the fifth head unit are located in accordant positions in the second direction;

wherein the second head unit and the third head unit are located in accordant positions in the second direction; and wherein the first head unit is dislocated from the second head unit in the second direction.

7. The ink jet printer according to claim 6;

wherein the two nozzle rows of the first head unit are configured to jet the black ink;

wherein the two nozzle rows of each of the fourth head unit and the fifth head unit are configured to jet a cyan ink and a magenta ink;

wherein the inner nozzle row of each of the second head unit and the third head unit are configured to jet the black ink; and wherein the outer nozzle row of each of the second head unit and the third head unit are configured to jet a yellow ink.

8. The ink jet printer according to claim 6;

wherein the first head unit is dislocated from the second head unit in the second direction by a dislocation amount equal to P/4.

9. The ink jet printer according to claim 6;

wherein the first head unit is dislocated from the second head unit in the second direction by a dislocation amount less than P/4.

10. The ink jet printer according to claim 1;

wherein the nozzles forming the first nozzle groups are located in accordant positions with the nozzles forming the second nozzle groups in the second direction; and wherein the nozzles forming the second nozzle groups are dislocated from the nozzles forming the third nozzle groups in the second direction.

11. The ink jet printer according to claim 10;

wherein a part of the nozzles forming the third nozzle groups are arranged on the upstream side from the second nozzle groups in the second direction.

12. The ink jet printer according to claim 1;

wherein the one of the third nozzle groups is arranged, in the first direction, between one of the first nozzle groups and the one of the second nozzle groups;

wherein the one of the third nozzle groups is arranged adjacent to the one of the first nozzle groups and the one of the second nozzle groups;

wherein the one of the second nozzle groups is arranged, in the first direction, between the one of the third nozzle groups and the other of the second nozzle groups;

wherein the one of the second nozzle groups is arranged adjacent to the one of the third nozzle groups and the other of the second nozzle groups;

wherein the other of the second nozzle groups is arranged, in the first direction, between the one of the second nozzle groups and the other of the third nozzle groups;

wherein the other of the second nozzle groups is arranged adjacent to the one of the second nozzle groups and the other of the third nozzle groups;

wherein the other of the third nozzle groups is arranged, in the first direction, between the other of the second nozzle groups and the other of the first nozzle groups; and wherein the other of the third nozzle groups is arranged adjacent to the other of the second nozzle groups and the other of the first nozzle groups.

13. The ink jet printer according to claim 1;

wherein the one of the third nozzle groups is arranged, in the first direction, between one of the first nozzle groups and the one of the second nozzle groups;

wherein the one of the third nozzle groups is arranged adjacent to the one of the first nozzle groups and the one of the second nozzle groups;

wherein the one of the second nozzle groups is arranged, in the first direction, between the one of the third nozzle groups and the other of the third nozzle groups;

wherein the one of the second nozzle groups is arranged adjacent to the one of the third nozzle groups and the other of the third nozzle groups;

wherein the other of the third nozzle groups is arranged, in the first direction, between the one of the second nozzle groups and the other of the second nozzle groups; and wherein the other of the third nozzle groups is arranged adjacent to the one of the second nozzle groups and the other of the second nozzle groups.

14. An ink jet printer comprising:

a carriage configured to move in a first direction;

an ink jet head mounted on the carriage, and including two first nozzle groups to jet a non-black ink, two second nozzle groups to jet a black ink, and two third nozzle groups to jet the black ink; and a controller configured to control the ink jet head;

wherein each of the first nozzle groups includes a plurality of nozzles arrayed at pitch P along a second direction intersecting the first direction, each of the second nozzle groups includes a plurality of nozzles arrayed at the pitch P along the second direction, and each of the third nozzle groups includes a plurality of nozzles arrayed at the pitch P along the second direction;

wherein the controller is configured to control the ink jet head to carry out ink jetting from the first nozzle groups and from the second nozzle groups but no ink jetting from the third nozzle groups, and to control the ink jet head to carry out ink jetting from the second nozzle groups and from the third nozzle groups but no ink jetting from the first nozzle groups;

wherein one of the first and second nozzle groups is arranged between the two of the third nozzle groups in the first direction; and wherein the two of the third nozzle groups are arranged, in the first direction, between two nozzle groups from among the two of the first nozzle groups and the two of the second nozzle groups other than the one of the first and second nozzle groups arranged between the two of the third nozzle groups.

15. An ink jet head configured to move in a first direction while jetting inks to a recording medium being conveyed in a second direction intersecting the first direction, the ink jet head comprising:

two first nozzle groups which are configured to jet a non-black ink and each of which includes a plurality of nozzles arrayed at a pitch P along the second direction;

two second nozzle groups which are configured to jet a black ink and each of which includes a plurality of nozzles arrayed at the pitch P along the second direction, positions of the nozzles in the second nozzle groups are coincide with those of the nozzles in the first nozzle groups in the second direction;

two third nozzle groups which are configured to jet the black ink and each of which includes a plurality of nozzles arrayed at the pitch P along the second direction, positions of the nozzles in the third nozzle groups being dislocated respectively from those of the nozzles in the second nozzle groups in the second direction;

wherein one of the second nozzle groups is arranged, in the first direction, between the two of the third nozzle groups;

wherein the two of the third nozzle groups are arranged, in the first direction, between two nozzle groups from among the two of the first nozzle groups and the other of the second nozzle groups; and wherein no nozzle for jetting ink other than the black ink is arranged between one of the third nozzle group and the other of third nozzle groups, in the first direction.

16. An ink jet printer comprising:

a carriage configured to move in a first direction; and an ink jet head mounted on the carriage, and including two first nozzle groups to jet first ink, two second nozzle groups to jet second ink, and two third nozzle groups to jet the second ink;

wherein each of the first nozzle groups includes a plurality of nozzles arrayed at a pitch P along a second direction intersecting the first direction, each of the second nozzle groups includes a plurality of nozzles arrayed at the pitch P along the second direction, and each of the third nozzle groups includes a plurality of nozzles arrayed at the pitch P along the second direction;

wherein positions of the nozzles of the second nozzle groups are coincident with those of the nozzles of the first nozzle groups in the second direction;

wherein positions of the nozzles of the third nozzle groups are dislocated respectively from those of the nozzles of the second nozzle groups in the second direction;

wherein one of the second nozzle groups is arranged, in the first direction, between the two of the third nozzle groups;

wherein the two of the third nozzle groups are arranged, in the first direction, between two nozzle groups from among the two of the first nozzle groups and the other of the second nozzle groups;

wherein no nozzle for jetting ink other than the second ink is arranged between one of the third nozzle groups and the other of the third nozzle groups, in the first direction;

wherein one of the two third nozzle groups is arranged on one side of the two second nozzle groups in the first direction, and the other of the two third nozzle groups is arranged on the other side of the two second nozzle groups in the first direction;

wherein one of the two first nozzle groups is arranged on one side of the two second nozzle groups and the two third nozzle groups in the first direction, and the other of the two first nozzle groups is arranged on the other side of the two second nozzle groups and the two third nozzle groups in the first direction;

wherein the ink jet head includes first, second and third head units, the first head unit being located between the second and third head unit in the first direction;

wherein each of the first, second and third head units includes two nozzle rows arranged side by side in the first direction, each of the nozzle rows including the nozzles arrayed at the pitch P in the second direction;

wherein the two nozzle rows of the first head unit are the two second nozzle groups;

wherein an inner nozzle row of the two nozzle rows in the second head unit in the first direction and an inner nozzle row of the two nozzle row in the third head unit in the first direction are the third nozzle groups; and wherein an outer nozzle row of the two nozzle rows in the second head unit in the first direction and an outer nozzle row of the two nozzle row in the third head unit in the first direction are the first nozzle groups.

* * * * *